US009061735B2

(12) United States Patent
Heyring et al.

(10) Patent No.: US 9,061,735 B2
(45) Date of Patent: Jun. 23, 2015

(54) MULTI-HULLED WATER CRAFT INCLUDING SUSPENSION

(71) Applicant: Nauti-Craft Pty Ltd, Margaret River (AU)

(72) Inventors: Christopher Brian Heyring, Eagle Bay (AU); John Gerard Catoni, Dunsborough (AU); Richard Monk, Busselton (AU)

(73) Assignee: Nauti-Craft Pty Ltd, Dunsborough (AU)

( * ) Notice: Subject to any disclaimer, the term of this patent is extended or adjusted under 35 U.S.C. 154(b) by 108 days.

(21) Appl. No.: 13/678,965

(22) Filed: Nov. 16, 2012

(65) Prior Publication Data

US 2013/0068151 A1 Mar. 21, 2013
US 2013/0233226 A2 Sep. 12, 2013

Related U.S. Application Data

(63) Continuation of application No. PCT/AU2011/000565, filed on May 16, 2011.

(30) Foreign Application Priority Data

May 16, 2010 (AU) ..... 2010902084

(51) Int. Cl.

| | |
|---|---|
| ***B63B 1/00*** | (2006.01) |
| ***B63B 1/14*** | (2006.01) |
| ***B63B 39/00*** | (2006.01) |
| ***B63B 27/30*** | (2006.01) |

(52) U.S. Cl.
CPC . *B63B 1/14* (2013.01); *B63B 39/00* (2013.01); *B63B 27/30* (2013.01)

(58) Field of Classification Search
CPC .... B63B 1/14; B63B 2001/145; B63B 1/121; B63B 1/107; B63B 7/02; B63B 7/04; B63B 39/00; B63B 27/30
USPC ..... 114/61.15
See application file for complete search history.

(56) References Cited

U.S. PATENT DOCUMENTS

| | | | | |
|---|---|---|---|---|
| 5,107,783 | A | 4/1992 | Magazzu | 114/123 |
| 5,228,404 | A * | 7/1993 | Gibbs | 114/61.16 |
| 7,314,014 | B2 | 1/2008 | Heyring et al. | 114/61.15 |
| 7,913,636 | B2 | 3/2011 | Meyer | 114/283 |
| 2007/0056496 | A1* | 3/2007 | Hodgson | 114/61.15 |
| 2010/0000454 | A1* | 1/2010 | Grenestedt | 114/61.15 |

OTHER PUBLICATIONS

Australian Patent Office, International Preliminary Report on Patentability, PCT/AU2011/000565, date of mailing Jul. 4, 2012, 6 pages.

* cited by examiner

*Primary Examiner* — S. Joseph Morano
*Assistant Examiner* — Anthony Wiest
(74) *Attorney, Agent, or Firm* — Sunstein Kann Murphy & Timbers LLP

(57) ABSTRACT

A multi-hulled water craft is disclosed. The water craft has a body, one left hull and one right hull, each hull connected to the body by respective locating means which permits at least substantially vertical and pitch motion of the respective hull relative to the body. The multi-hulled water craft also has a suspension system including at least a front left modal support means and a back left modal support means for providing at least partial support of the body with respect to the left hull, and at least a front right modal support means and a back right modal support means for providing at least partial support of the body with respect to the right hull. The suspension system further includes interconnection means connected to the modal support means to provide different stiffness between motions in at least two of roll, pitch, heave and warp suspension modes.

21 Claims, 21 Drawing Sheets

MULTI-HULLED WATER CRAFT INCLUDING SUSPENSION

This application is a continuation of Patent Cooperation Treaty Patent Application PCT/AU2011/000565 filed May 16, 2011, which is incorporated herein by reference.

TECHNICAL FIELD

The present invention relates to multi-hulled water craft and more specifically to water craft including a body or chassis and two moveable hulls.

BACKGROUND ART

There are known various different types of multi-hulled water craft. Most twin hulled vessels or catamarans have the two hulls fixed to a common chassis and superstructure (body) or integral with the body, but this generates high stresses in the structure. For example when large waves are encountered head-on and the hulls slam into the waves, without resilient suspension there is a high acceleration transmitted directly to the body or chassis which not only generates high loads through the structure, but also high forces on the occupants with such slamming events causing significant discomfort. Typically the tunnel between the left and right hulls is closed and has its top (the belly of the body) above the water, but during slamming the tunnel can become filled with water generating further high loads into the structure and more jarring inputs to the occupants. If large waves are encountered at an angle, the pitching moments on the left and right hulls can differ greatly, generating high torsional loads and stresses in the structure.

Similarly, most vessels with three hulls (trimarans) have all three hulls fixed to a common chassis or the three hulls and the body are molded and bonded together. Again, slamming of the rigid hulls and reaching the limited capacity of the tunnels between the hulls can induce high accelerations and stresses on the structure, occupants and any cargo of most conventional trimarans where the hulls are fixed and waves encountered at an angle can generate high torsional loads.

In such multi-hulled vessels it is known to provide a torsionally resilient chassis to absorb some of the wave energy and reduce the loading and corresponding weight of the chassis. It has alternatively been proposed to provide resilient suspension in the form of individual coil springs between the hulls and the chassis. While this arrangement adds resilient suspension between the side hulls and the body or chassis, it has the disadvantage that it provides the same fixed stiffness in each suspension mode (roll, pitch, heave and warp), so any reduction in the warp stiffness to reduce torsional loading into the body results in a corresponding reduction in roll, pitch and heave stiffness.

SUMMARY

In accordance with a first aspect of the present invention, there is provided a multi-hulled water craft comprising a body (or chassis structure), one left hull and one right hull, each hull connected to the body by respective locating (geometry) means which permits at least substantially vertical and pitch motion of the respective hull relative to the body, the multi-hulled water craft further including: a suspension system including at least a front left modal support means and a back left modal support means for providing (partial) support of the body with respect to the left hull, and at least a front right modal support means and a back right modal support means for providing (partial) support of the body with respect to the right hull; the suspension system further including interconnection means, the interconnection means being connected to the modal support means to (passively) provide different stiffness between motions in at least two suspension modes from roll, pitch, heave and warp (torsion). That is, the arrangement of the interconnection means and modal support means inherently (i.e. passively, without the need for any sensors, external control or power input) provides a modal stiffness feature where the stiffness of the modal support means differs between at least two suspension modes. The interconnected modal support means can still optionally be actively controlled, the modal functionality of the interconnection means generally facilitating easy active control of the four modal support means.

The suspension system may be arranged to substantially support the body (above the left and right hulls). i.e. The body does not continually engage the water surface, the multi-hulled water craft is a catamaran.

The interconnection means of the suspension system may provide a pitch stiffness between the body and the average pitch position of the left and right hulls relative to the body (pitch displacement of the left and right hulls in opposite directions is a warp mode displacement). The suspension system may further include pitch attitude control means for controlling the pitch attitude of the vessel, for example by providing springs and dampers actuated in the pitch mode, and/or by providing powered active attitude adjustment. Alternatively, the interconnection means may provide a roll and/or heave stiffness with a lower (or zero) pitch and/or warp (torsional) stiffness.

Alternatively, the body of the multi-hulled water craft may include a fixed hull (in contact with the water), the side hulls providing only partial support of the body. i.e. The body usually engages the water surface, the multi-hulled water craft is a trimaran.

Optionally, the interconnection means of the suspension system may provide a pitch stiffness of the left and right hulls relative to the body (but not relative to each other as there is substantially zero torsional stiffness between the modal support means). The suspension system may further include (hull) pitch attitude control means for controlling the pitch attitude of the left and right hulls. For example, if the side hulls provide a low portion of the pitch buoyancy of the water craft, the suspension system can adjust the pitch attitude of the left and right hulls to assist planing. Alternatively, the interconnection means may provide a roll and/or pitch stiffness with a lower heave and/or warp (torsional) stiffness.

Alternatively, the body of the multi-hulled water craft may include a water engaging portion, the body being movable between a first position where the water engaging portion is in contact with the water and a second position where the water engaging portion is above the water.

The interconnection means may provide at least a roll or pitch stiffness between the body and the left and right hulls without providing a corresponding torsional stiffness between the modal support means. Alternatively, or additionally, the interconnection means may provide at least a roll stiffness between the body and the left and right hulls while providing substantially zero torsional stiffness between the modal support means.

The suspension system may further include at least one independent support device to provide partial support of the body independent of the interconnection means. For example, a respective independent support device may be provided between each hull and the body, the independent support device (such as a coil spring, air spring or hydro-pneumatic cylinder) being located between the front and the back modal support means of the hull thereby providing roll and heave stiffness. Alternatively, a front and a rear independent support device may be provided on each hull thereby providing stiffness in each of the roll, pitch, heave and warp suspension modes.

The respective locating means of the left and right hulls may each include a front and a back locating linkage means. For example, each front left, back left, front right and back right locating linkage means may include a respective trailing (or leading) arm, one of the front or back locating linkage means of the left hull and one of the front or back locating linkage means of the right hull including a respective intermediate link, each intermediate link having a first connecting point rotatably connected to the respective trailing arm and having a second connecting point rotatably (where the intermediate link is a drop link) or slidably (for example, where the intermediate link includes a sleeve) connected to the body or the respective hull. Additionally or alternatively, the respective modal support means may each include at least one hydraulic ram connected between the body or chassis and the respective locating means.

The suspension system may further include roll attitude control means for controlling the roll attitude of the vessel. Similarly, the suspension system may further include pitch attitude control means for controlling the pitch attitude of the vessel.

Each modal support means may comprise at least one hydraulic ram and the interconnection means may include fluid conduits. Fluid pressure accumulators may be provided in fluid communication with the modal support means (and therefore the interconnection means) to add resilience and allow design control of the different stiffness between motions in different suspension modes. The resilience may be controlled in use using damper valves or other control valves. Additionally or alternatively, damping means may be provided in at least one of said modal support means to provide motion damping of the modal support means.

The interconnection means may further include at least one modal displacement device. For example a roll (mode) displacement device may be provided, a displacement of the roll displacement device being related to the roll mode displacement of the modal support means of the suspension system. Similarly modal displacement devices for the pitch, warp and/or heave modes may be provided. The displacement of the modal displacement device may be resilient to reduce the stiffness of the suspension system in the corresponding mode. Additionally or alternatively, the displacement of the modal displacement device may be actively controlled to drive the position of the body relative to the left and right hulls.

In accordance with a second aspect of the present invention, there is provided a catamaran comprising a body (or chassis structure) suspended above a left hull and a right hull, each hull connected to the chassis by respective locating means which permits at least substantially vertical and pitch motion of the respective hull relative to the chassis, the catamaran further including a suspension system including a front left support means and a back left support means for providing support of the body or chassis above the left hull, and a front right support means and a back right support means for providing support of the body or chassis above the at least one right hull, each respective support means including respective modal support means; the suspension system further including at least one interconnection means connected to at least two of the modal support means to passively provide different stiffness between motions in at least two suspension modes from roll, pitch, heave and warp (torsion).

In accordance with a third aspect of the present invention, there is provided a trimaran comprising a body (or chassis structure) supported above a fixed hull, a left moveable hull and a right moveable hull, the fixed hull being fixed to or integral with the body or chassis, the left hull being positioned to the left of the fixed hull and connected to the body and/or fixed hull by connecting means including at least a front left modal support means and at least a back left modal support means, the right hull being positioned to the right of the fixed hull and connected to the body and/or fixed hull by connecting means including at least a front right modal support means and at least a back right modal support means, wherein said modal support means are interconnected to passively provide at least a roll stiffness or a pitch stiffness with a reduced or zero torsional stiffness.

It will be convenient to further describe the invention by reference to the accompanying drawings which illustrate preferred aspects of the invention. Other embodiments of the invention are possible and consequently particularity of the accompanying drawings is not to be understood as superseding the generality of the proceeding description of the invention.

DETAILED DESCRIPTION

Figure 1:
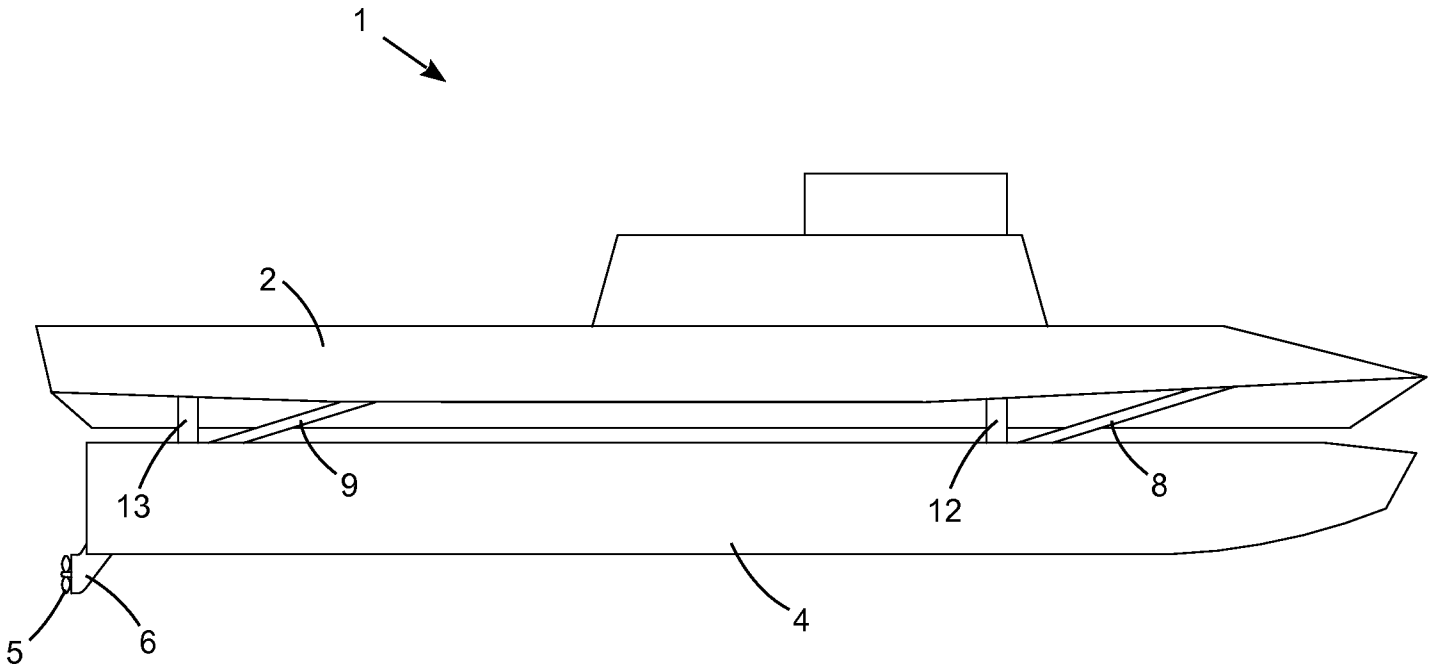
FIG. 1 is a diagrammatic side view of a twin-hulled water craft in accordance with at least one embodiment of the present invention.
Figure 2:
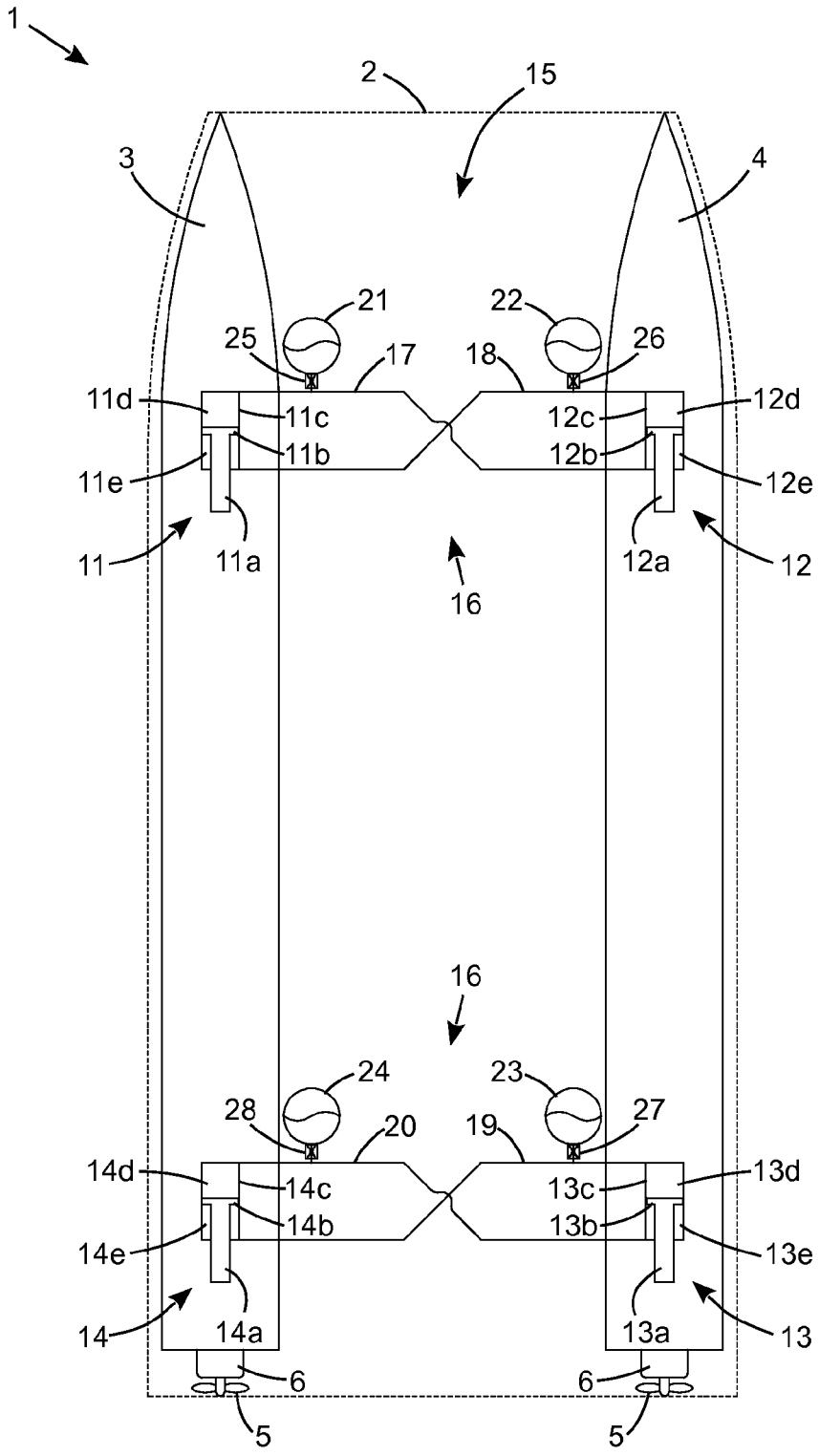
FIG. 2 is a diagrammatic plan view of a twin-hulled water craft in accordance with an embodiment of the present invention.

Referring initially to FIGS. 1 and 2 there is a multi-hulled water craft 1 having a body or chassis 2 connected to a left hull 3 and a right hull 4. As the body does not contact the water (at least not on flat water in the position shown in FIG. 1), but is supported above the left and right (water engaging) hulls, the water craft in FIGS. 1 and 2 is a twin-hulled water craft commonly known as a catamaran. The body or chassis is shown as a dotted outline for clarity in FIG. 2. Propulsion means are shown as a propeller 5 on a leg 6 mounted off the rear of both (left and right) side hulls, although alternate or additional propulsion means can be used and alternate locations can be used such as a longer leg extending down from the body to engage the water.

In the present invention, the side hulls are moveable relative to the body or chassis. Any locating means which permits vertical and pitch motion of each hull individually relative to the body can be used. Typically a locating means (geometry) is used including linkages such as trailing arms, leading arms, drop links, wishbones or sliding joints for example and many locating geometries can also provide location of the side hulls about their individual roll axes. Two longitudinally spaced locating linkages are preferably used on each hull to provide yaw location of the hull and distribute loads into the hull and the body. These are shown by a front locating arm 8 and a back locating arm 9 in FIG. 1, although the locating (geometry) means are omitted in FIG. 2 for clarity.

The body 2 is suspended above the left and right hulls by a suspension system 15 which includes at least two longitudinally spaced support means between each hull and the body to provide roll and pitch stiffness in addition to vertical support and heave stiffness. In FIG. 2 the suspension system includes a front left ram 11, a front right ram 12, a back right ram 13 and a back left ram 14. Each ram is double-acting, i.e. the rod (11*a*, 12*a*, 13*a* or 14*a*) is connected to a piston (11*b*, 12*b*, 13*b* or 14*b*) which divides the cylinder (11*c*, 12*c*, 13*c* or 14*c*) into a compression chamber (11*d*, 12*d*, 13*d* or 14*d*) and a rebound chamber (11*e*, 12*e*, 13*e* or 14*e*). Preferably the cylinder of each ram is connected to the chassis and the rod of each ram is connected to the associated hull or related geometry.

The suspension system includes interconnection means 16 to provide different stiffness between at least two suspension modes. Rams having interconnections to other rams to provide modal functionality (such as different stiffness or damping between at least two of the suspension modes of roll, pitch heave and warp) may be termed modal rams. The compression chamber (11*d*, 12*d*, 13*d*, or 14*d*) of each (front left, front right, back right, back left) modal support ram is connected to the rebound chamber (12*e*, 11*e*, 14*e* or 13*e* respectively) of the laterally spaced ram by a respective compression conduit 17, 18, 19 or 20 to form respective compression volumes. Each compression volume requires some resilience for the system to operate, so a respective hydro-pneumatic pressure accumulator 21, 22, 23 or 24 is shown on the compression conduit of each compression volume. The system can require damping, although the damping required can depend on the locating geometry of the side hulls. Damper valves (25, 26, 27 or 28) are shown between each accumulator and its respective compression volume, although damper valves can be provided in the conduits and/or at the ram ports.

Figure 3:
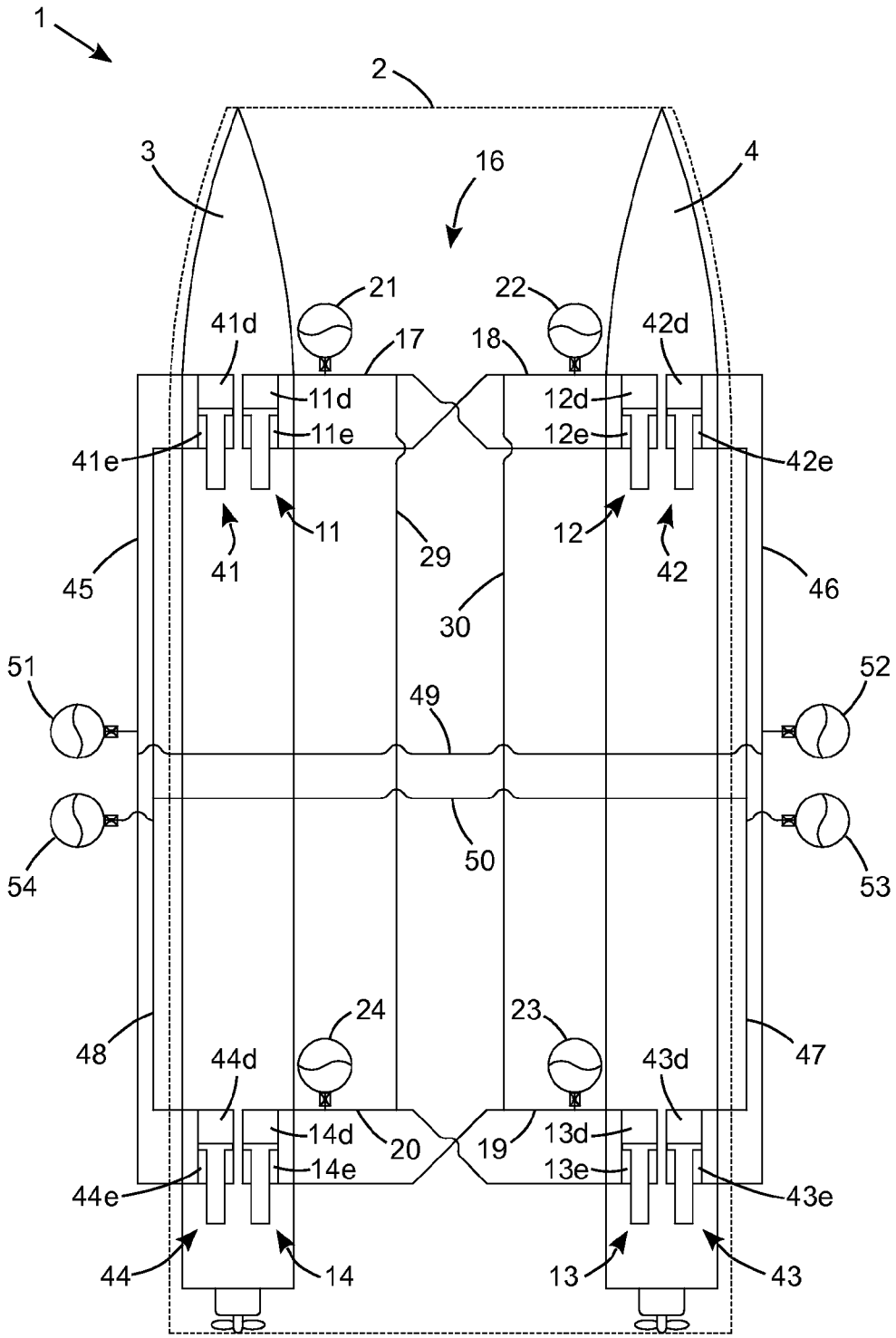
FIG. 3 is a schematic diagram showing an alternative suspension system layout for a water craft in accordance with the present invention.

The suspension system interconnection shown in FIG. 2 provides a heave and pitch stiffness rate related to the difference between the upper and lower piston face areas (i.e. the rod cross-sectional areas) of the modal support rams and the resilience in the compression volumes. It also provides a higher roll and warp (torsional) stiffness related to the addition of the upper and lower piston face areas and the resilience in the compression volumes. The difference between the stiffness rate in roll and warp vs. the stiffness rate in heave and pitch can therefore be changed by changing the relative rod and cylinder bore dimensions of the modal support rams. The provision of a lower pitch stiffness can provide significant benefits in reducing stresses and discomfort due to slamming. However, as generally a significant or high roll stiffness is desirable, the suspension system of FIG. 2 would provide a correspondingly high warp stiffness which would transmit torsional loads into the body. FIG. 3 shows additional features added to the suspension system from FIG. 2 to provide a reduced warp stiffness. Throughout the figures, like components have like reference numerals.

In FIG. 3, the front left compression volume is connected to the back left compression volume by a left roll compression conduit 29 forming a left roll volume. Similarly, the front right compression volume is connected to the back right compression volume by a right roll compression conduit 30 forming a right roll volume. This additional interconnection maintains the roll stiffness, but removes the warp and pitch stiffness from the rams 11, 12, 13 and 14 and their associated accumulators and conduits, which together can be designated as a roll circuit. Reducing or removing the warp stiffness reduces or prevents the rams 11, 12, 13 and 14 from applying a torsional load to the body, even when the water surface is warped such as when encountering large waves obliquely (up to the limit of travel of at least one of the rams).

A similar circuit, rotated through ninety degrees in plan view is also provided to supply a pitch stiffness to the suspension system, this circuit being a pitch (control) circuit. A front left pitch support ram 41, front right pitch support ram 42, a back right pitch support ram 43 and a back left pitch support ram 44 are shown, each being a double-acting ram including a respective compression chamber 41*d*, 42*d*, 43*d* or 44*d* and respective rebound chamber 41*e*, 42*e*, 43*e* or 44*e*. The front left pitch compression chamber 41*d* is connected to the back left pitch rebound chamber 44*e* by a front left pitch compression conduit 45 forming a front left pitch compression volume. The front right pitch compression chamber 42*d* is connected to the back right pitch rebound chamber 43*e* by a front right pitch compression conduit 46 forming a front right pitch compression volume. The back right pitch compression chamber 43*d* is connected to the front right pitch rebound chamber 42*e* by a back right pitch compression conduit 47 forming a back right pitch compression volume. The back left pitch compression chamber 44*d* is connected to the front left pitch rebound chamber 41*e* by a back left pitch compression conduit 48 forming a back left pitch compression volume. The front pitch compression volumes are connected by front pitch compression conduit 49 forming a front pitch volume (although any layout of conduits connecting the front pitch compression chambers to the back pitch rebound chambers can be used). The back pitch compression volumes are connected by back pitch compression conduit 50 forming a back pitch volume (although any layout of conduits connecting the back pitch compression chambers to the front pitch rebound chambers can be used). Although there is an accumulator (51, 52, 53, or 54) shown in each of the front left, front right, back right and back left pitch compression volumes, only one source of resilience is required for the front pitch volume and one for the back pitch volume. Alternatively one accumulator can be provided for each ram chamber. The front and back pitch volumes can be designated as a pitch circuit since it provides a pitch stiffness with zero roll or warp stiffness.

The rams of the roll (and pitch) circuits can provide a support force in addition to providing a heave stiffness and a roll (or pitch) stiffness dependent in part on the difference between the effective piston areas in compression and rebound. The ram cylinder and rod diameters can be designed to give the desired roll, pitch and heave stiffness rates for design pressures for each roll and pitch compression volume. The operating pressure in each volume can be varied in operation to vary the proportion of weight of the body borne on the roll circuit vs. the pitch circuit which can be used to vary the roll stiffness vs. the pitch stiffness to adjust the suspension characteristics to suit the running conditions such as sea state and angle to wave fronts. For example in a head sea, a low pitch stiffness can be desirable to absorb the wave inputs and minimize body motion and conversely in a beam sea, a low roll stiffness can be desirable (dependent on characteristics such as wave frequency and vessel size).

Figure 4:
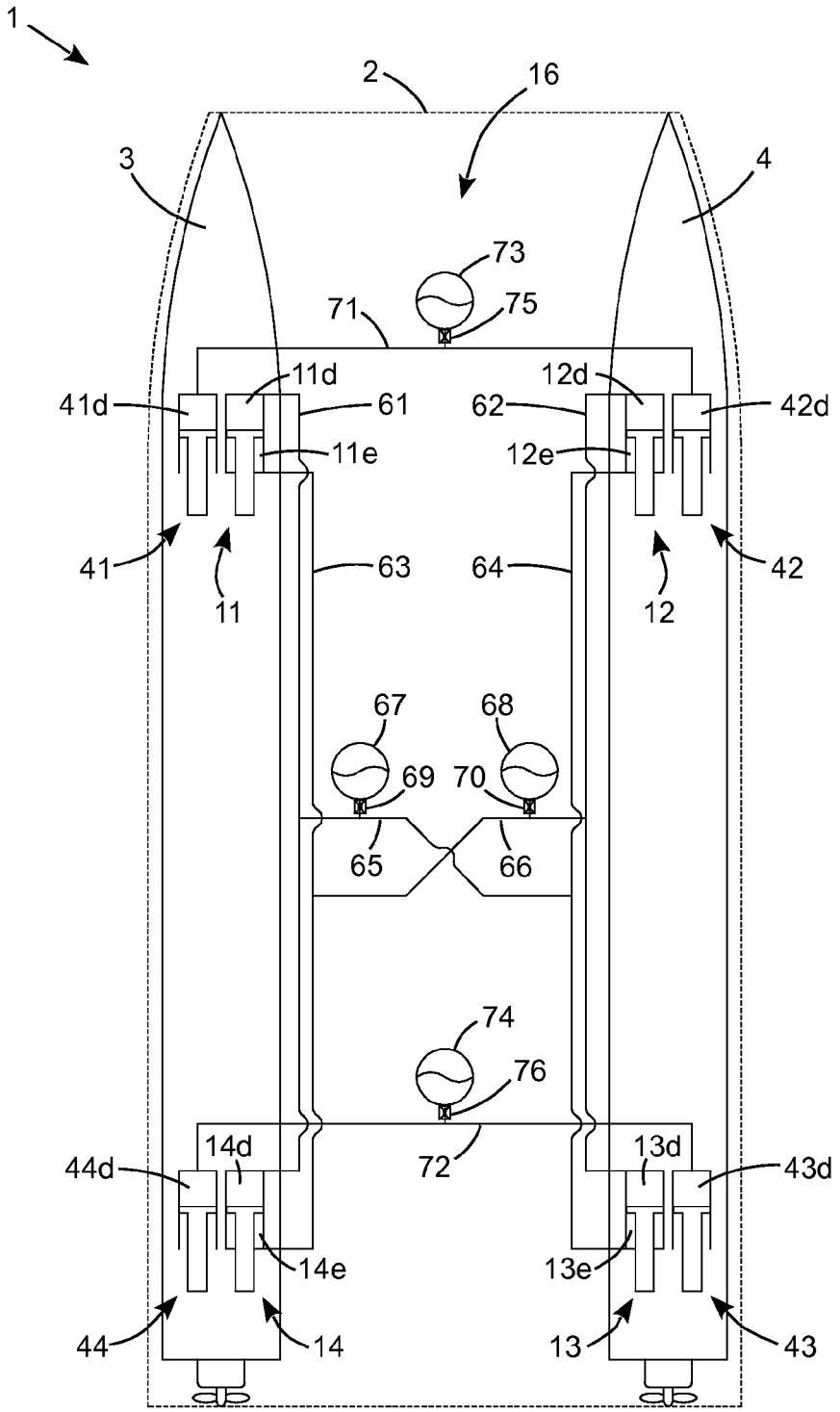
FIG. 4 is a schematic diagram showing an alternative connectivity of a suspension system for a water craft in accordance with the present invention.

FIG. 4 shows a similar suspension arrangement to FIG. 3 having roll volumes and pitch volumes. In FIG. 4 the roll circuit utilizes a different layout of conduits although the left roll volume still includes the compression chambers of the left rams and the rebound chambers of the right rams, and the right roll volume still includes the compression volumes of the right rams and the rebound chambers of the left rams.

In more detail, in the roll circuit the compression chambers 11*d* and 14*d* of the left rams 11 and 14 are interconnected by a left roll compression conduit 61 forming a left roll compression volume. Similarly, the compression chambers 12*d* and 13*d* of the right rams 12 and 13 are interconnected by a right roll compression conduit 62 forming a right roll compression volume. The rebound chambers 11*e* and 14*e* of the left rams 11 and 14 are interconnected by a left roll rebound conduit 63 forming a left roll rebound volume and the rebound chambers 12*e* and 13*e* of the right rams 12 and 13 are interconnected by a right roll rebound conduit 64 forming a right roll rebound volume. The left roll compression volume is connected to the right roll rebound volume by a left roll conduit 65 forming a left roll volume. The right roll compression volume is connected to the left roll rebound volume by a right roll conduit 66 forming a right roll volume. A left roll accumulator 67 is shown connected to the left roll volume via optional roll damper valve 69 and a right roll accumulator 68 is shown connected to the right volume via optional roll damper valve 70.

In FIG. 4, the pitch support rams 41, 42, 43 and 44 are now single acting and laterally interconnected forming two separate pitch volumes. The front left and front right pitch compression chambers (41*d* and 42*d*) are interconnected by front pitch compression conduit 71 forming a front pitch compression volume and the back right and back left pitch compression chambers are interconnected by back pitch compression conduit 72 forming a back pitch compression volume. A front pitch accumulator 73 and a back pitch accumulator 74 are shown connected to the respective pitch compression volumes via optional damper valves 75 and 76. This separate front and rear pitch compression volume arrangement can be used and gives the same heave stiffness and pitch stiffness at the pitch support rams while providing substantially zero roll stiffness.

Figure 5:
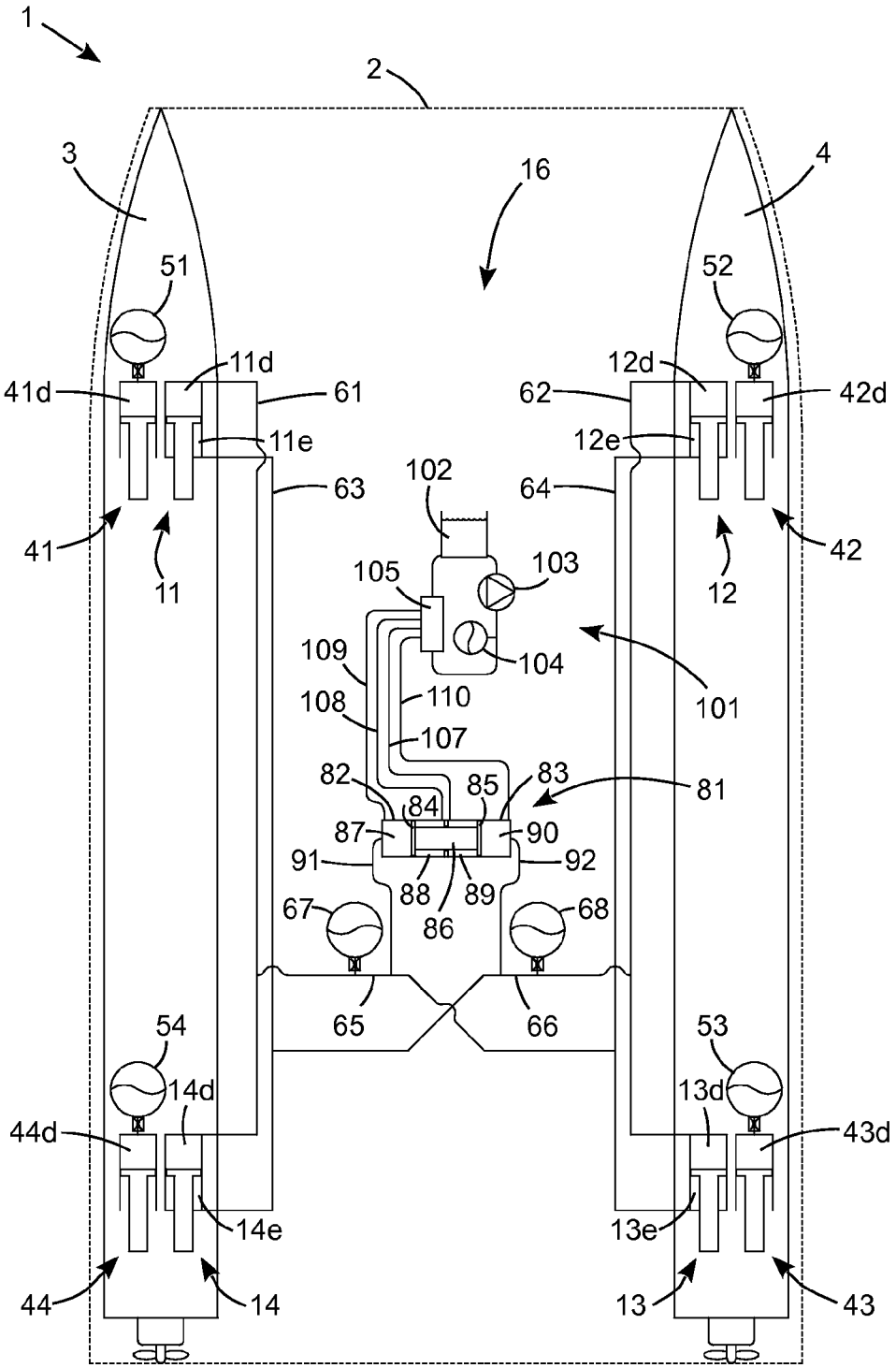
FIG. 5 is a schematic diagram showing an attitude control addition to the suspension system of FIG. 4.

FIG. 5 shows the same roll circuit as FIG. 4, with the addition of a roll fluid displacement device 81 and a fluid supply system 101. The roll displacement device 81 comprises a pair of axially aligned cylinders 82, 83, divided into two pairs of reciprocal chambers 87, 88 and 89, 90 by pistons 84 and 85 which are interconnected by a rod 86. The left roll volume chamber 87 is connected to the left roll volume by conduit 91 and the right roll volume chamber 90 is connected to the right roll volume by conduit 92. Supplying high pressure fluid to the left roll control chamber 88 displaces the piston rod assembly of 84, 85, 86 to compress the left roll volume chamber 87, displacing fluid into the left roll volume. It also simultaneously expands the right roll volume chamber 90 which draws fluid to be displaced from the right roll volume. Conversely, supplying high pressure fluid to the right roll control chamber 89 displaces the piston rod assembly of 84, 85, 86 to compress the right roll volume chamber 90, displacing fluid into the right roll volume, simultaneously expanding the left roll volume chamber 87 which draws fluid to be displaced from the left roll volume. So while the roll circuit still provides the desired roll stiffness to the body 2 above the hulls 3 and 4, the roll attitude of the body can be adjusted using a fluid supply system. This can be beneficial for example where the roll stiffness is set at a level to provide good comfort in a variety of conditions, but only good roll attitude control when travelling a straight line. Then when turning, the fluid supply system 101 can be used to improve the roll attitude of the vessel.

The fluid supply system 101 includes a fluid reservoir or tank 102, a pump 103, a supply pressure accumulator 104 and a valve manifold 105 containing multiple valves to enable control of the ingress or egress of fluid to or from individual volumes of the suspension system. The fluid supply system can be used for active control by supplying fluid at high pressures and flow rates to the roll control chambers 88 and 89 through control conduits 107 and 108. Additionally or alternatively, the fluid supply system can be used for a maintenance function to correct the volume of fluid in each volume of the suspension system (such as the roll volumes as shown with conduits 109 and 110). If the roll displacement device 81 is omitted, the fluid supply system can still be connected to the left and right roll volumes to allow active control and/or maintenance. Many alternate fluid supply system arrangements are known, for example omitting the tank if pressure maintenance is not required, omitting the tank and pump if a simple pressure maintenance is all that is required, or omitting the supply accumulator (which can increase pump load and system response time) and there are many possible arrangements of valves within the manifold.

The left and right roll control chambers can alternatively or additionally include accumulators with damper valves and/or lockout valves. These can be used to selectively absorb roll inputs at some speeds or frequencies, but still resist roll at other times.

In FIG. 5 the pitch support rams 41, 42, 43 and 44 are shown as independent single-acting rams with respective accumulators 51, 52, 53 and 54. The use of independent support means such as these independent rams adds the same stiffness in each mode (roll, warp, pitch and heave) which can be of benefit when used with additional modal support means, for example to add a minimum level of roll or pitch stiffness as a failsafe. Where the catamaran body has a high load carrying capability, additional support rams can be added to each hull, preferably between the front and back support rams 11 and 14 or 12 and 13 to distribute the loads between the hulls and the body or chassis across a greater number of points and a greater area. These additional support rams can be independent or interconnected and single or double acting. For example they can be laterally cross connected as in FIG. 2, and if they are at the center of pitch of the left and right hulls, they could not add warp stiffness. Multiple rams can be added per hull, preferably spaced between the front and back rams. These additional rams can be interconnected on each hull to provide heave and roll stiffness without adding pitch or warp stiffness.

Figure 6:
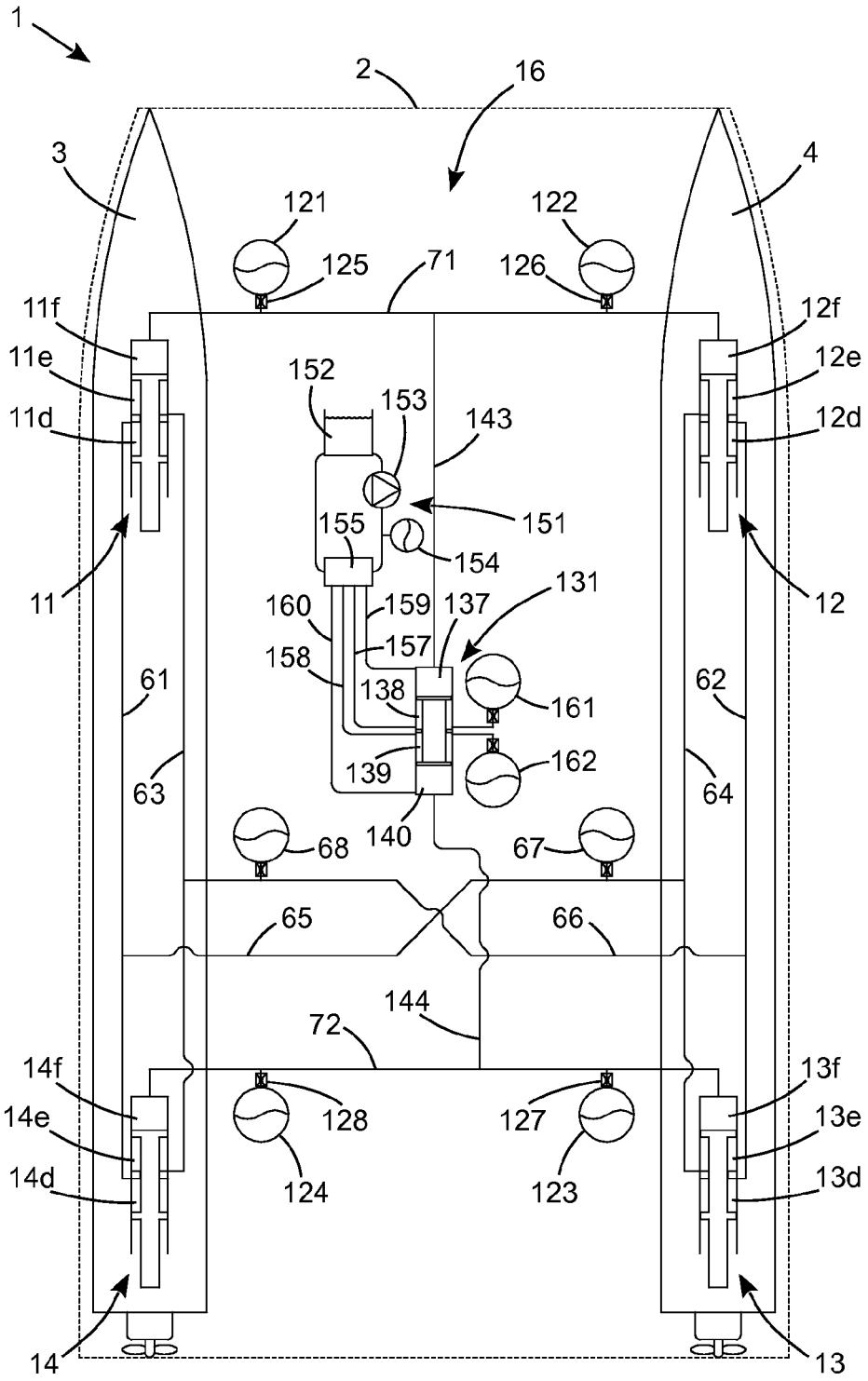
FIG. 6 is a schematic diagram showing a further modification of the suspension system of FIG. 4 incorporating an alternative attitude control addition.

FIG. 6 shows a roll control suspension system of the same connectivity and similar functionality to those in FIGS. 3, 4 and 5, which can utilize the roll displacement device and/or the supply system from FIG. 5 (omitted for clarity). However the construction of the modal support rams is different with the rams having an additional compression chamber or support chamber 11*f*, 12*f*, 13, or 14*f* which can in some ways be seen as analogous to the compression chambers of the single acting rams 41, 42, 43, and 44 in FIGS. 4 and 5. In the construction of rams shown in FIG. 6, the compression chambers (11*d*, 12*d*, 13*d*, 14*d*) and rebound chambers (11*e*, 12*e*, 13*e*, 14*e*) are reversed in position and can easily have equal effective piston face areas, which can remove the push-out or support force from the compression and rebound chambers, but the support chambers (11*f*, 12*f*, 13*f*, 140 can provide all the support forces required. In this case the roll compression volumes provide a roll stiffness without providing a warp, pitch or heave stiffness.

The front left support chamber 11*f* is connected to the front right support chamber 12*f* by a front pitch support conduit 71 forming a front pitch volume and the back right support chamber 13*f* is connected to the back left support chamber 14*f* by a back pitch support conduit 72 forming a back pitch volume. This provides a pitch and heave stiffness without adding a roll or a warp stiffness. Accumulators (121, 122, 123, 124) and optional damper valves (125, 126, 127, 128) can be added to the front and back pitch volumes.

A pitch or pitch fluid displacement device 131 and fluid supply system 151 are also shown, having similar construction to the roll fluid displacement device and supply system in FIG. 5. This provides a front pitch volume chamber 137 connected to the front pitch volume by front pitch displacement conduit 143 and a back pitch volume chamber 140 connected to the back pitch volume by conduit 144. The supply system 151 has a reservoir 152, pump 153, supply accumulator 154 and valve manifold 155 as in FIG. 5 and if a roll control supply system is also provided, some of these parts can be shared. Adjusting the displacement of the piston rod assembly of the pitch displacement device can adjust the pitch attitude of the body or chassis 2 relative to the average pitch attitude of the left and right hulls (3 and 4). The control system 151 can supply fluid through the front and back pitch control conduits 157 and 158 to displace the piston-rod assembly of the pitch displacement device through the front and back control chambers 138 and 139. The front and back supply conduits 159 and 160 can be used to maintain the front and back pitch volumes or, if the pitch displacement device is omitted, to control the pitch attitude body above the left and right hulls.

Alternatively or additionally to the supply system, pitch resilience accumulators 161 and 162 may be provided in fluid communication with the front and back control chambers 138 and 139. This can provide a lower pitch stiffness than heave stiffness, i.e. different relative stiffness between pitch and heave compared to the options from FIGS. 3 and 4. It should be noted that these options from FIGS. 3 and 4 could also be controlled with the addition of a control system including a fluid supply system.

Figure 7:
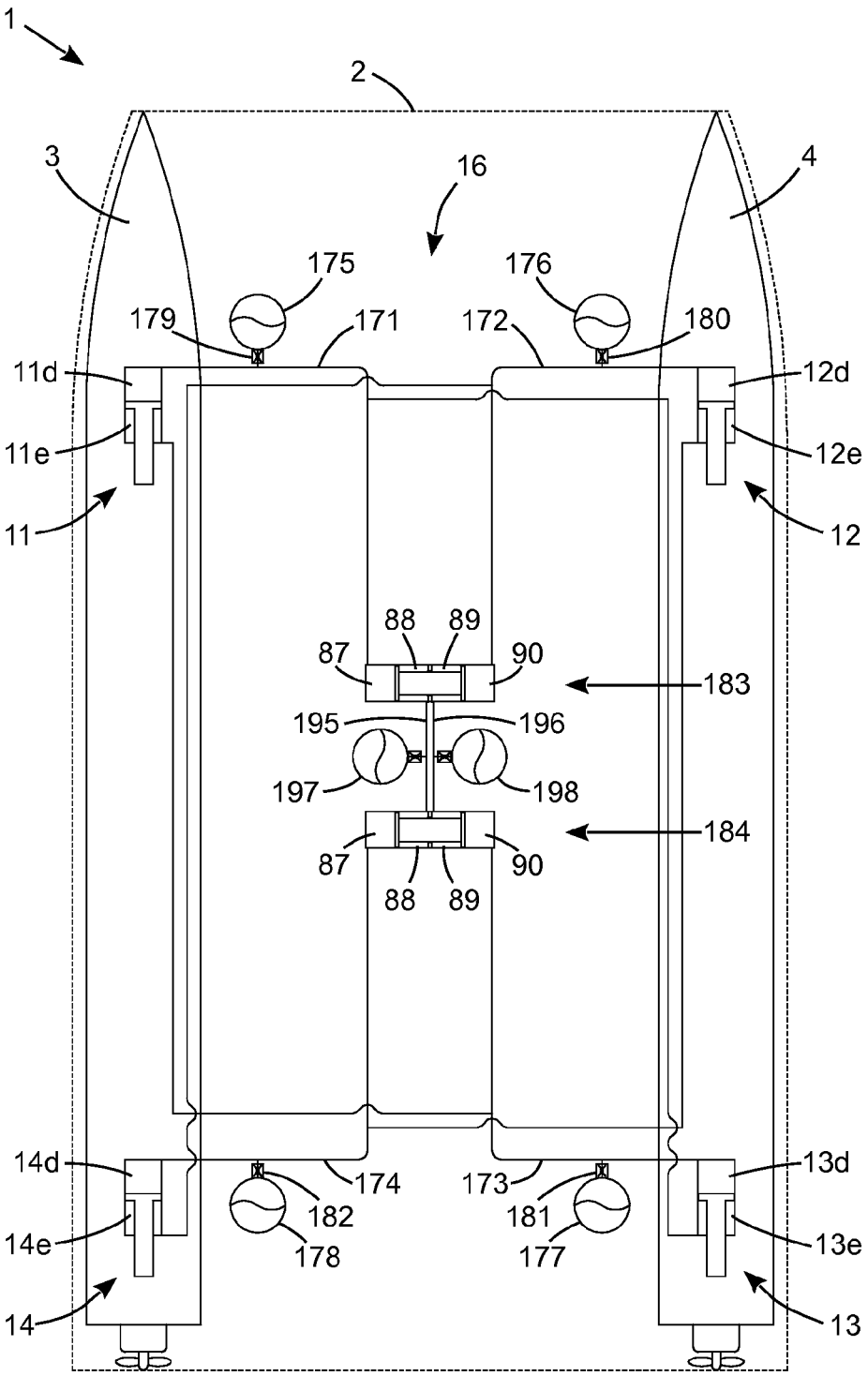
FIGS. 7 to 10 are schematic diagrams each showing an individual further alternative connectivity of a suspension system for a water craft in accordance with the present invention.
Figure 8:
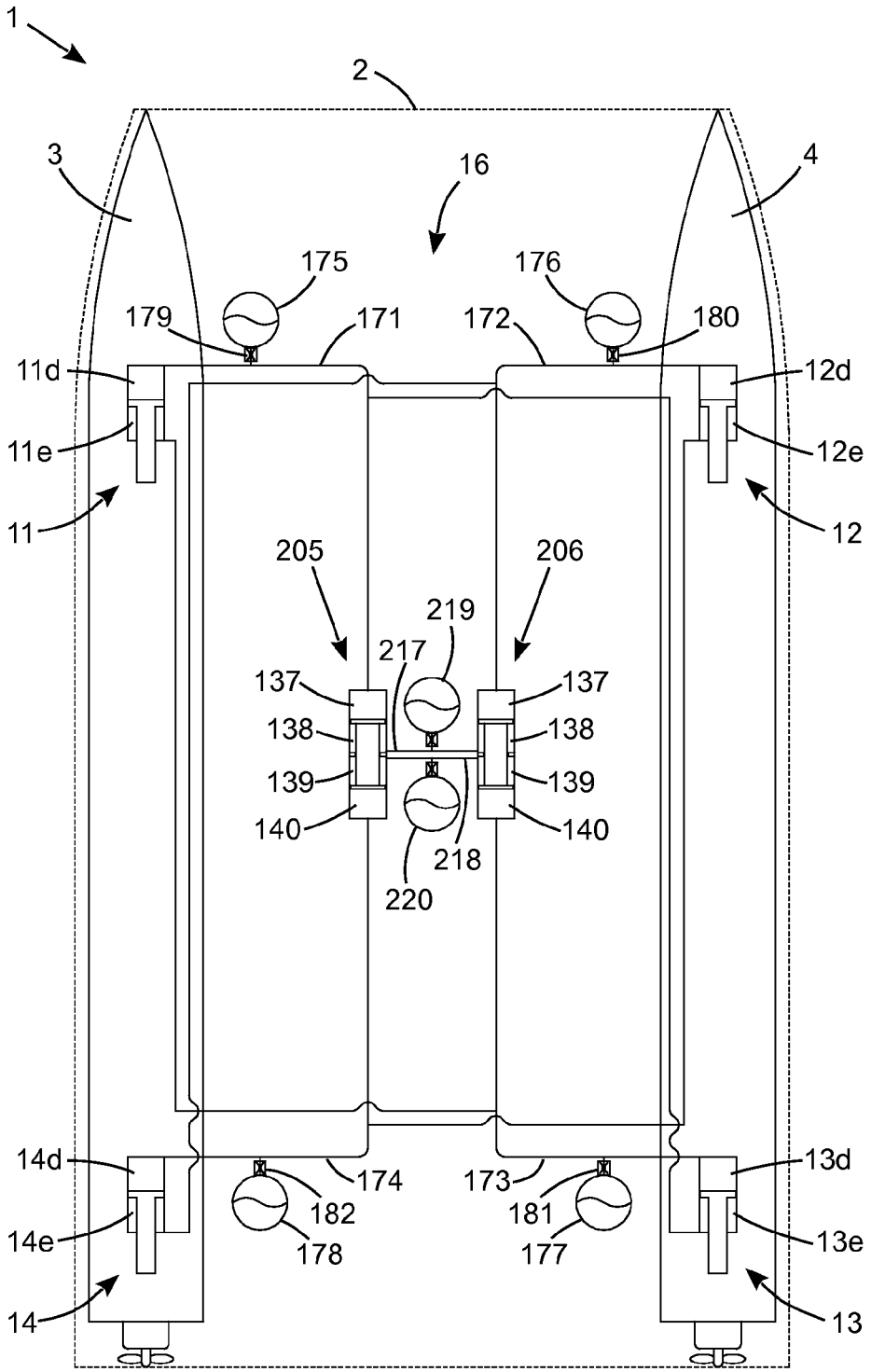

In FIGS. 7 and 8, while the front left, front right, back right and back left double-acting rams (11, 12, 13 and 14) are again used between the left and right hulls and the chassis or body, they are now diagonally cross-connected, i.e. the compression chamber (11*d*, 12*d*, 13*d* or 14*d*) of the respective ram is connected to the rebound chamber (13*e*, 14*e*, 11*e* or 12*e*) of the diagonally opposite ram by a respective compression conduit (171, 172, 173 or 174) forming front left, front right, back right and back left compression volumes. Resilience is provided in each of these compression volumes by at least one (optional) respective accumulator (175, 176, 177 or 178). This interconnection arrangement would provide a high roll and pitch stiffness with a lower heave and warp (or torsional) stiffness. While such an arrangement could be used, it is preferable to provide additional cylinders and piston rod assemblies to substantially remove the warp stiffness and allow the roll or preferably the pitch stiffness to be reduced.

In FIG. 7 there is effectively a front roll displacement device 183 between the front left and front right compression volumes, and a back roll displacement device 184 between the back left and back right compression volumes, each roll displacement device having a similar construction and operation to the roll displacement device 81 in FIG. 5. The left control chambers 88 of each roll displacement device are interconnected by a left roll conduit 195 forming a left control volume and the right control chambers 89 of each roll displacement device are interconnected by a right roll conduit 196 forming a right control volume, these interconnections removing the warp stiffness from the hydraulic suspension arrangement. A left roll resilience accumulator 197 is provided on the left control volume and a right roll resilience accumulator 198 is provided on the right control volume, these accumulators adding roll resilience to reduce the roll stiffness of the suspension system to below the pitch stiffness. These roll control volumes can be controlled using a fluid supply system as described in relation to FIG. 6. So the arrangement in FIG. 7 passively provides a high pitch stiffness with independently lower roll and heave stiffness rates and zero warp stiffness.

However it can be preferable to provide a high roll stiffness with a lower pitch stiffness, so in FIG. 8 there is effectively a left pitch displacement device 205 between the front left and back left compression volumes, and a right pitch displacement device 206 between the front right and back right compression volumes, each pitch displacement device having a similar construction and operation to the pitch displacement device 131 in FIG. 6. The front control chambers 138 of each pitch displacement device are interconnected by a front pitch conduit 217 forming a front control volume and the back control chambers 139 of each pitch displacement device are interconnected by a back pitch conduit 218 forming a back control volume, these interconnections removing the warp stiffness from the hydraulic suspension arrangement. A front pitch resilience accumulator 219 is provided on the front control volume and a back pitch resilience accumulator 220 is provided on the back control volume, these accumulators adding pitch resilience to reduce the pitch stiffness of the suspension system to below the roll stiffness. These pitch control volumes can be controlled using a fluid supply system as described in relation to FIG. 6. So the arrangement in FIG. 8 passively provides a high roll stiffness with independently lower pitch and heave stiffness rates and zero warp stiffness.

Figure 9:
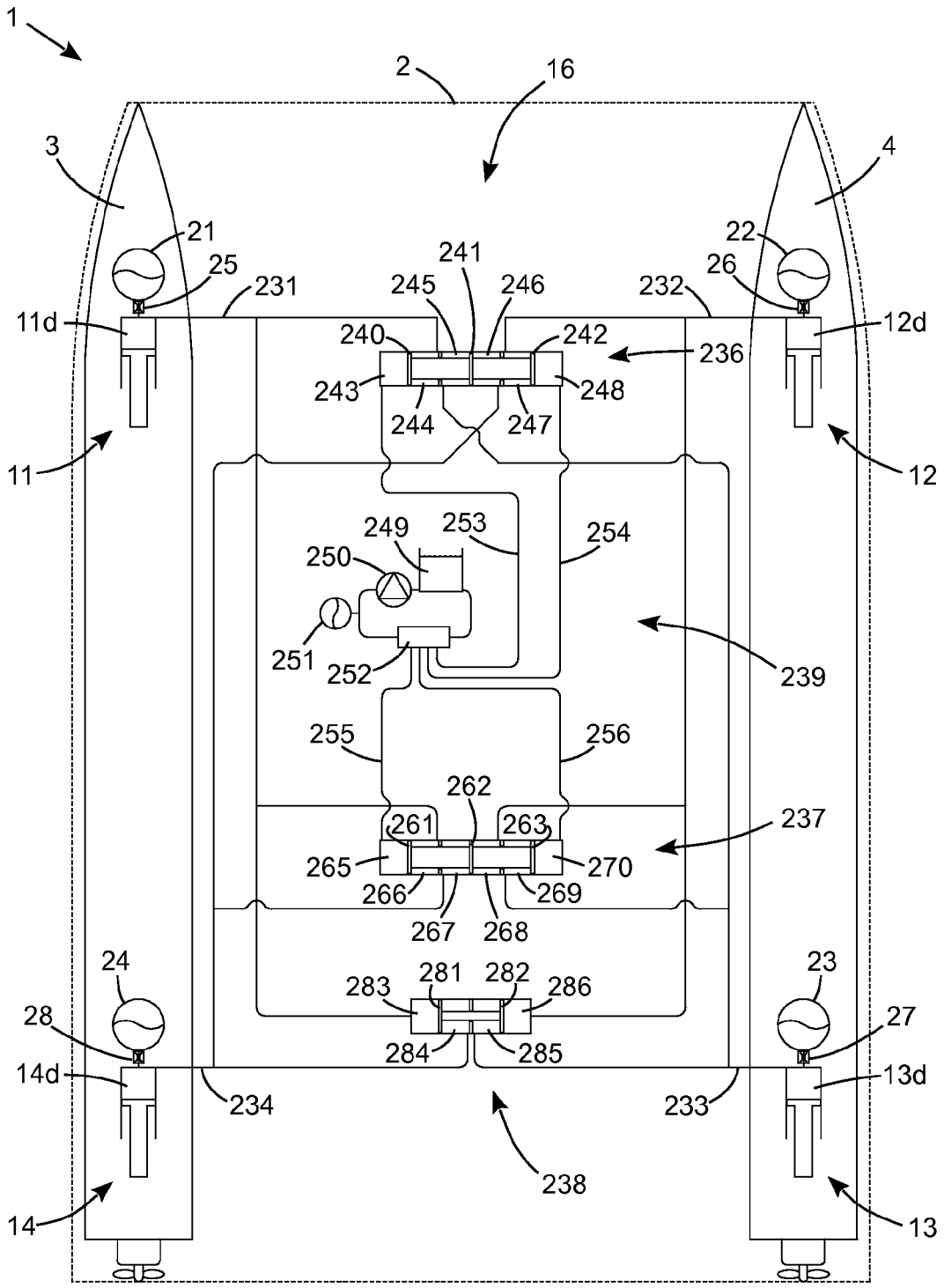

In FIG. 9 the modal support rams 11, 12, 13 and 14 are single-acting, i.e. each has only a compression chamber (11*d*, 12*d*, 13*d* or 14*d*). A rebound chamber can be provided, connected to the compression chamber of the same ram by a damper valve to provide optimal rebound damping if required. However, if the rams provide a significant push-out force, damping the accumulators can provide ample rebound as well as compression damping. To that end the compression chamber (11*d*, 12*d*, 13*d* or 14*d*) of each ram is in fluid communication with a respective accumulator (21, 22, 23 or 24) via an accumulator damper valve (25, 26, 27 or 28). A compression conduit (231, 232, 233 or 234) is connected to the respective support ram compression chamber forming a respective compression volume.

In the interconnection means 16 between the modal support rams, there is provided a roll displacement device 236, a pitch displacement device 237 and a warp displacement device 238, each connected to each of the compression chambers. An optional control and/or supply system 239 is shown connected to the roll and pitch devices, including a reservoir 249, a pump 250, a supply accumulator 251 and a valve manifold 252.

The roll displacement device 236 includes three axially aligned cylinders, each divided into a pair of chambers by a respective piston 240, 241, 242. The three pistons are interconnected by two rods forming three pairs of interrelated, reciprocal volume chambers. The front left roll chamber 244 is connected to the front left compression conduit 231 and the back left roll chamber 246 is connected to the back left compression conduit 234, the front and back left roll chambers varying in volume in unison with motion of the piston rod assembly. The front right roll chamber 247 is connected to the front right compression conduit 232 and the back right roll chamber 245 is connected to the back right compression conduit 233, the front and back right roll chambers varying in volume in unison with motion of the piston rod assembly and in the opposite direction to the front and back left roll chambers. At either end of the device are left and right roll displacement chambers (243 and 248) which vary in volume with motion of the piston rod assembly. These roll displacement chambers can each have a respective left roll and right roll accumulator (not shown) to provide additional roll resilience. However, as the accumulators at the support rams provide the same roll resilience as heave resilience, if they are used it is preferable to omit the roll accumulators and use the supply system to vary the volume of the roll displacement chambers to thereby adjust the roll attitude of the vessel using control conduits 253 and 254.

The pitch displacement device 237 similarly includes three axially aligned cylinders, each divided into a pair of chambers by a respective piston 261, 262, 263. The three pistons are interconnected by two rods forming three pairs of interrelated, reciprocal volume chambers. The front left pitch chamber 266 is connected to the front left compression conduit 231 and the front right pitch chamber 268 is connected to the front right compression conduit 232, the front left and right pitch chambers varying in volume in unison with motion of the piston rod assembly. The back right pitch chamber 269 is connected to the back right compression conduit 233 and the back left pitch chamber 267 is connected to the back left compression conduit 234, the back left and right pitch chambers varying in volume in unison with motion of the piston rod assembly and in the opposite direction to the front left and right pitch chambers. At either end of the device are front and back pitch displacement chambers (265 and 270) which vary in volume with motion of the piston rod assembly. These pitch displacement chambers can each have a respective front pitch and back pitch roll accumulator (not shown) to provide additional pitch resilience. However, as the accumulators at the support rams provide the same pitch resilience as heave resilience, if they are used it can be preferable to omit the pitch accumulators and use the supply system to vary the volume of the pitch displacement chambers to thereby adjust the pitch attitude of the body or chassis above the left and right hulls using control conduits 255 and 256.

The supply system may also include control conduits (not shown) connected to each support ram compression volume to correct for fluid volume variations due to temperature or leakage.

The warp displacement device 238 includes two axially aligned cylinders, each divided into a pair of chambers by a respective piston 281, 282. The two pistons are interconnected by a rod forming two pairs of interrelated, reciprocal volume chambers. The front left warp chamber 283 is connected to the front left compression conduit 231 and the back right warp chamber 285 is connected to the back right compression conduit 233, the front left and back right warp chambers varying in volume in unison with motion of the piston rod assembly. The front right warp chamber 286 is connected to the front right compression conduit 232 and the back left warp chamber 284 is connected to the back left compression conduit 234, the front right and back left warp chambers varying in volume in unison with motion of the piston rod assembly and in the opposite direction to the front left and back right warp chambers. The piston rod assembly is therefore free to move and transfer fluid between the compression volumes in a warp motion, removing the warp stiffness of the suspension system.

Figure 10:
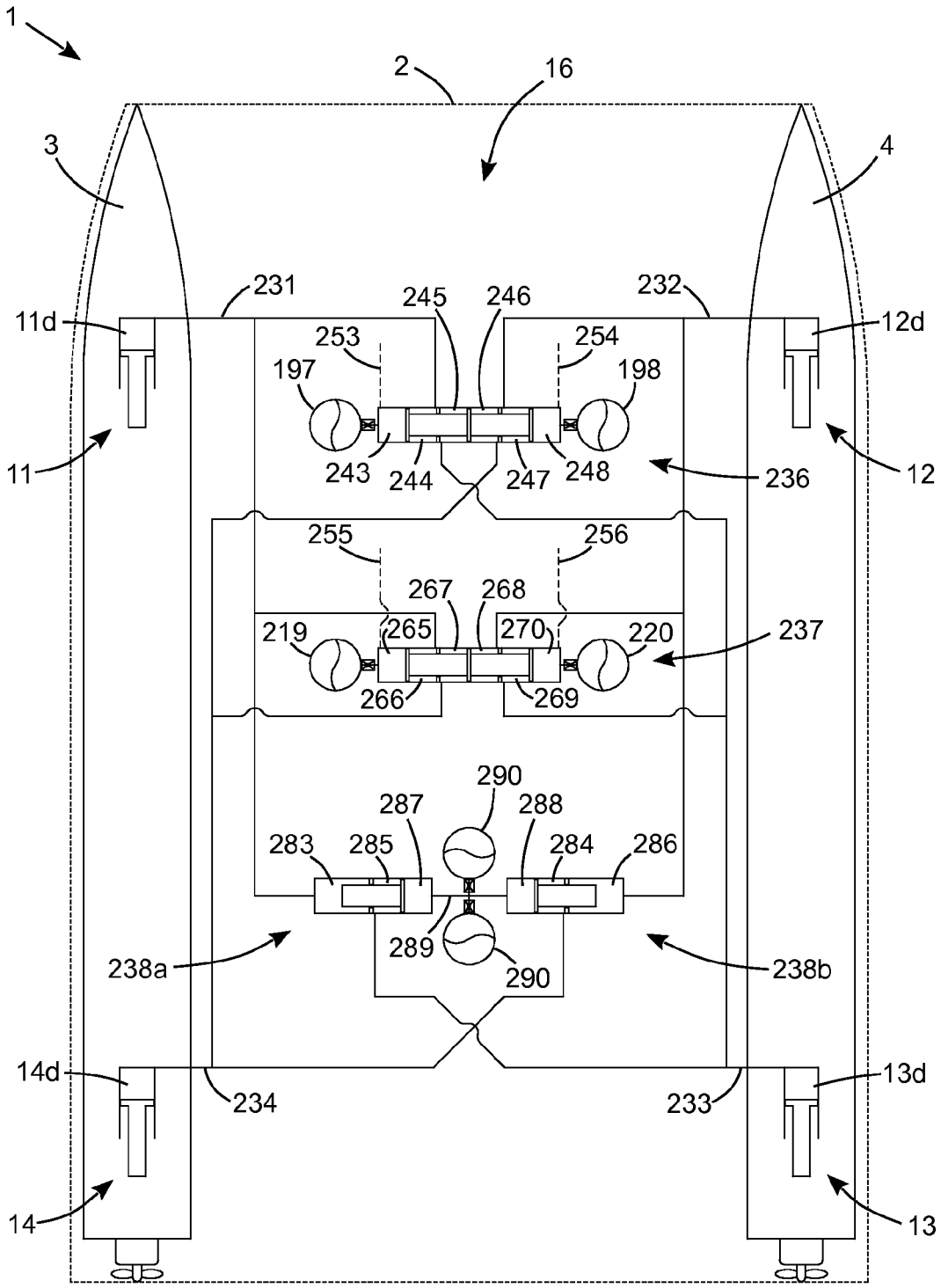

FIG. 10 shows a similar interconnection means 16 to that in FIG. 9. However in this case the warp device also adds heave resilience so the resilience in each compression volume (the accumulators 21, 22, 23 and 24 in FIG. 9) can be omitted. If there is less or little resilience in the compression volumes associated with each support ram, it can be necessary to provide the optional roll resilience accumulators and pitch resilience accumulators discussed but not shown in FIG. 9.

The warp device is now effectively two diagonal displacement devices, with the first diagonal displacement device 238*a* being connected to the diagonally opposite pair of front left and back right modal support rams and the second diagonal displacement device 238*b* being connected to the diagonally opposite pair of front right and back left modal support rams. As the front left and back right support rams are compressed, the piston rod assembly in diagonal displacement device 238*a* is displaced and front left and back right warp chambers (283 and 285) expand. This compresses a first diagonal chamber 287. If the suspension mode is warp, the fluid displaced from the first diagonal chamber is displaced into the second diagonal chamber 288 via conduit 289 and the warp displacement occurs with substantially zero stiffness. If the displacement mode is heave, then fluid is displaced out of the first and second diagonal chambers 287 and 288 and into accumulators 290 which provide heave resilience to the suspension system. The warp device does not provide pitch resilience, so the pitch displacement device 237 is still required to provide pitch resilience to the suspension system.

In FIG. 10, as there are accumulators for roll, pitch and heave, the stiffness and damping characteristics of each individual mode can be easily set.

In any of the catamaran type multi-hulled vessels shown in FIGS. 1 to 10, the body may be suspended well above the surface of the water in which the side hulls are floating. In this case the body may only contact spray from the water, or the crests of large waves. However the body can be lowered relative to the side hulls to reduce the center of mass or to adjust the body height relative to a jetty or neighboring vessel for example. In this case, the body may contact the water more often, so the body can for example optionally include a surface or region that is designed to contact the water without slamming, i.e. the body can include a water engaging portion. However, the body can be designed to normally sit in the water, in which case the water engaging portion is generally a hull attached to or integrated with the body. The body may still be lifted out of the water, for example at high speed, or it may provide significant buoyancy to support the body in all operating conditions.

Figure 11:
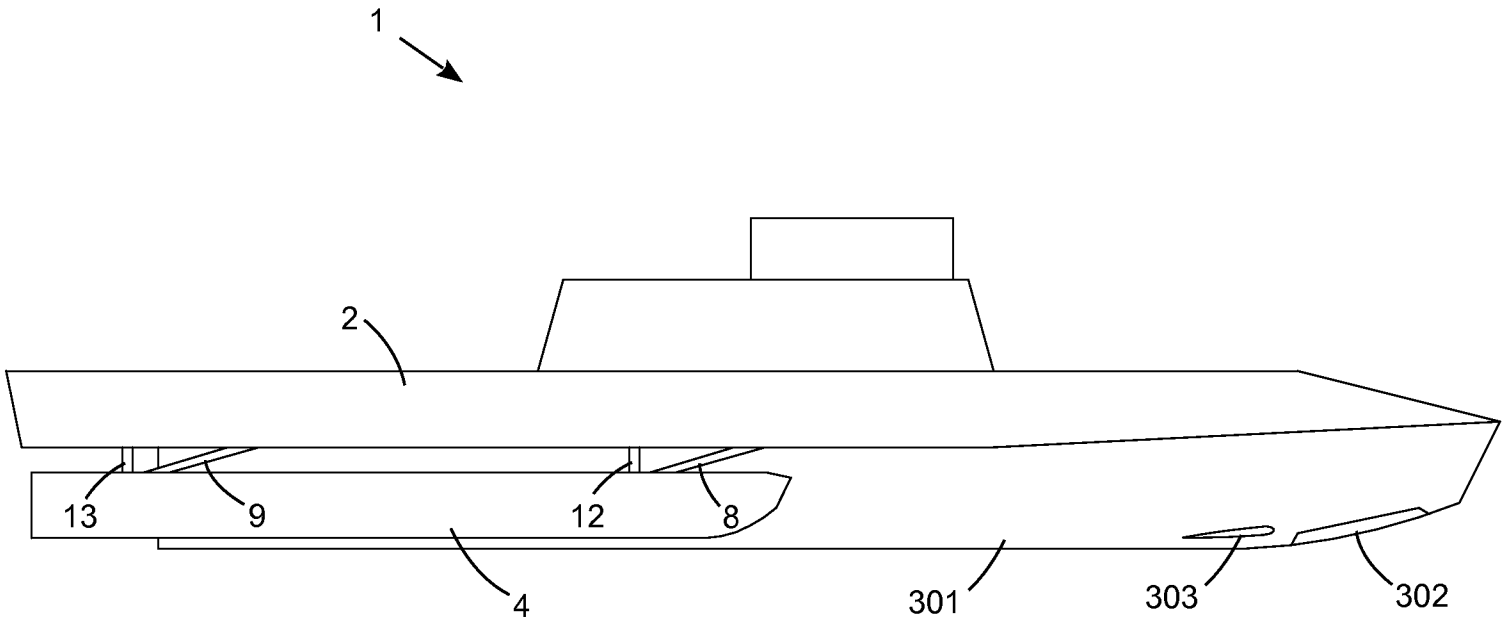
FIG. 11 is a diagrammatic side view of a tri-hulled water craft in accordance with at least one embodiment of the present invention.
Figure 12:
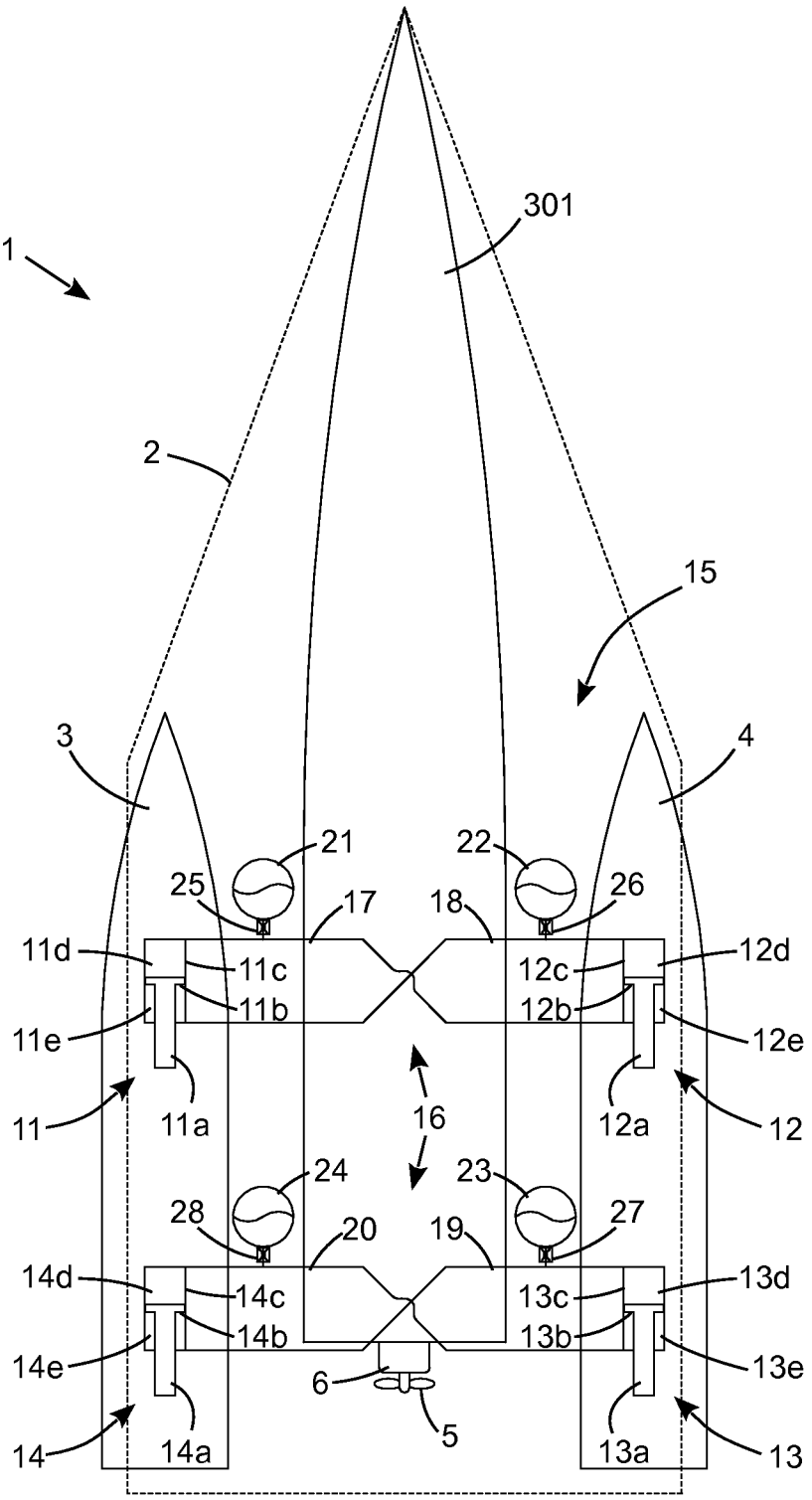
FIG. 12 is a diagrammatic plan view of a tri-hulled water craft in accordance with at least one embodiment of the present invention.

FIGS. 11 and 12 show a multi-hulled vessel 1 where the body 2 includes a fixed hull 301 which partially supports the body, the remainder of the support of the body still being provided by the moveable left and right hulls 3 and 4. The multi-hulled vessel shown in FIGS. 11 and 12 can be classed as a trimaran as it has three hulls. The body or chassis is shown as a dotted outline for clarity in FIG. 12 and can have the fixed hull (301) formed as an integral part as shown in FIG. 11, or fixed in any known manner to the body or chassis. Although a central fixed hull is shown, the fixed hull is not limited to being in the center of the water-craft. Propulsion means are shown as a propeller 5 to the rear of the central fixed hull although alternate propulsion means can be used and can for example alternatively or additionally be on the left and right side hulls.

Conventionally, the left and right hulls of a trimaran are fixed to the chassis, so while they provide stability (functioning rather like outriggers) their buoyancy must generally be limited to limit the bending and torsional loads they impart on the chassis. Providing resilience between the left and right hulls and the body or chassis permits them to provide greater buoyancy and support of the chassis or reduce the loads input to the body or chassis. Therefore the suspension system 15 utilizes a forward and a rearward ram (such as shown at 12 and 13 in FIG. 11) on each side hull for many reasons such as: to distribute load; to permit pitch stiffness or attitude control of each side hull; or to utilize a location which uses hull locating geometry as a lever to reduce ram stroke and permit protected packaging of the rams and other hydraulic components. However, if multiple independent resilient supports are provided between each side hull and the body, then the roll, pitch, heave and warp stiffness rates are all the same (when measured as ram displacement in each mode).

To further reduce the loads input to the body or chassis, the suspension system 15 of the side hulls includes interconnection means 16 to permit the rams to provide different stiffness rates in different displacement modes of the suspension, i.e. the support rams of the suspension system are interconnected to decouple the stiffness in different modes (at least in part, even if optionally, additional independent support means are provided), in which case the support rams can be termed modal support rams. This can allow the left and right hulls to have even greater buoyancy and/or the chassis to be made lighter as some bending or torsional loads can be reduced.

As with the catamaran example in FIG. 1, the side hulls of the trimaran in FIG. 11 are located relative to the body and the fixed hull by geometry formed by linkages which can include a front locating arm 8 and a back locating arm 9, although various locating means can be used.

FIG. 11 also shows two optional features towards the front of the fixed hull. A portion 302 of the bow can be moveable or pressure sensing to sense the contact of the front of the vessel with waves being encountered. This can be used along with other inputs such as water speed as an input into a pitch attitude control for the side hulls or to a vessel pitch attitude control. A fin or foil 303 is also shown which can be used either in place of the sensing portion 302 of the bow or as is known as a pitch stabilizing device for the vessel.

The suspension system interconnection shown in FIG. 12 has a similar layout to the suspension system shown for the catamaran in FIG. 2. Like and similar features are indicated with like reference numerals. The suspension system provides a side hull heave and pitch stiffness rate related to the difference between the upper and lower piston face areas (i.e. the rod cross-sectional areas) of the modal support rams and the resilience in the compression volumes. It also provides a higher roll and warp stiffness related to the addition of the upper and lower piston face areas and the resilience in the compression volumes. The difference between the stiffness rate in roll and warp vs. the stiffness rate in heave and pitch can therefore be changed by changing the relative rod and cylinder bore dimensions of the modal support rams. As with the catamaran of FIG. 2, the system can require damping, although the damping required can depend on the locating geometry of the side hulls. Damper valves (25, 26, 27 or 28) are shown between each accumulator and its respective compression volume, although damper valves can be provided in the conduits and/or at the ram ports.

In the configuration of trimaran shown in FIG. 12 where the fixed hull 301 is considerably longer than the side hulls and has a greater distribution of buoyancy in a pitch direction than the side hulls 3 and 4, control of the side hulls in a pitch direction may not provide a high degree of control of the pitch attitude of the body, unlike in the previous catamaran examples where the side hulls provided all of the vertical support and pitch stiffness of the body. However advantages of the trimaran are that the side hulls may not necessarily require any pitch stiffness or that control of the pitch stiffness and/or attitude of the side hulls can be used for example to help the side hulls rise up onto the plane or adopt an efficient attitude suited to the sea condition.

Figure 13:
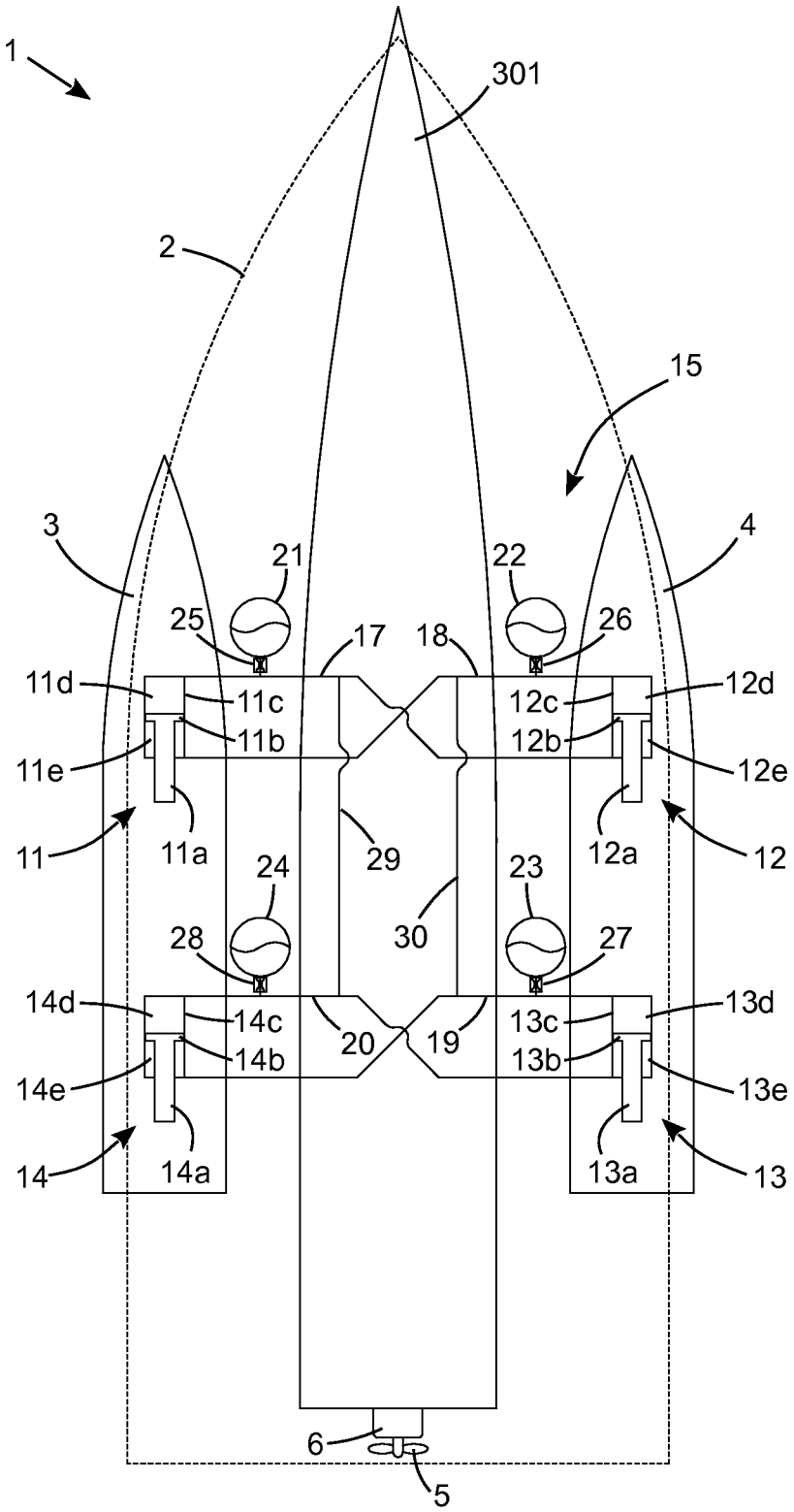
FIGS. 13 to 15 are schematic diagrams each showing an individual further alternative connectivity of a suspension system for a water craft in accordance with the present invention.

The trimaran in FIG. 13 incorporates respective left and right roll compression conduits (29 and 30) interconnecting the front and back left, and front and back right compression volumes respectively in the same connection sequence as FIG. 3, removing the warp stiffness from the arrangement of modal support rams in the suspension system (and removing the corresponding torsional loading into the body or chassis). Although this also removes the pitch stiffness from the arrangement of modal support rams, as noted above if a large, long hull fixed to the body is used (as shown again in FIG. 13) the requirement for the side hulls to provide or contribute a pitch stiffness function to the body is reduced or removed. The side hulls (3 and 4) are also shown moved forward compared to FIG. 12, now being nearer the middle of the vessel than the rear.

Figure 14:
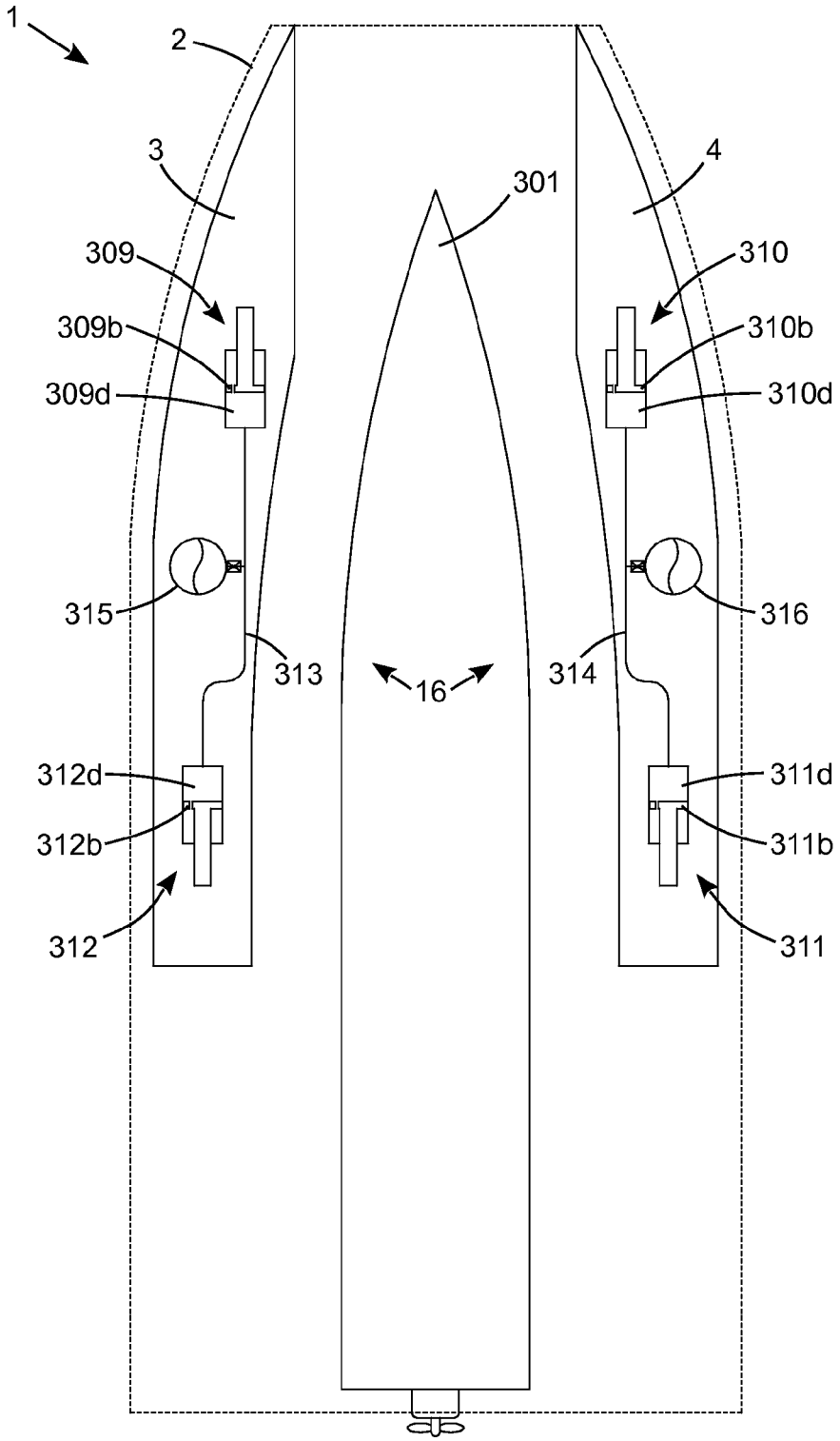

Indeed the side hulls can be located at any fore/aft position and in FIG. 14 are shown even further forwards towards the front of the vessel. In this position, the buoyancy provided by the side hulls can help support the front of the body above the water where the fixed hull has little buoyancy. Some designs use low forward buoyancy to pierce through waves, but where it is desirable to keep the front deck clear of most wave inputs, the use of forward side hulls as illustrated in FIG. 14 can be beneficial. An alternative modal ram interconnection providing zero pitch stiffness for the side hulls is also shown in FIG. 14. In this case the modal support rams are single-acting rams 309, 310, 311 and 312 having the front left compression chamber 309*d* connected to the back left compression chamber 312*d* by a left compression conduit 313 and the front right compression chamber 310*d* connected to the back right compression chamber 311*d* by a right compression conduit 314. Accumulators 315 or 316 are provided on each conduit. This arrangement provides resilient support with a common heave and roll stiffness and zero warp and pitch stiffness for the interconnected modal support rams of the suspension system 15. Damping can be provided as shown by connecting the across the piston (309*b*, 310*b*, 311*b* or 312*b*) between the compression chamber and the rebound chamber of each ram through a damper valve as is known. Alternatively, damping can be provided between the fluid in the compression chambers (and conduit) and the resilience provided by the accumulator 315 or 316 although this leaves the pitch mode of the side hulls with neither stiffness nor damping (although damping could be provided in the conduits) and the ability to provide rebound damping in heave is also limited by the pressure in the support rams. As a further alternative, the compression chambers can be interconnected as shown and the rebound chamber can be similarly interconnected on each side hull (with the rams having solid pistons) in a similar arrangement to the pitch circuit of the catamaran in FIG. 3. Such pitch circuits can include the equivalent of front and back pitch compression conduits (49 and 50) from FIG. 3 to provide a pitch stiffness with zero roll or warp stiffness. Although in a trimaran suspension some roll stiffness is usually required of the side hulls, the pitch circuit could be used in addition to a roll circuit to permit hull pitch control.

Figure 15:
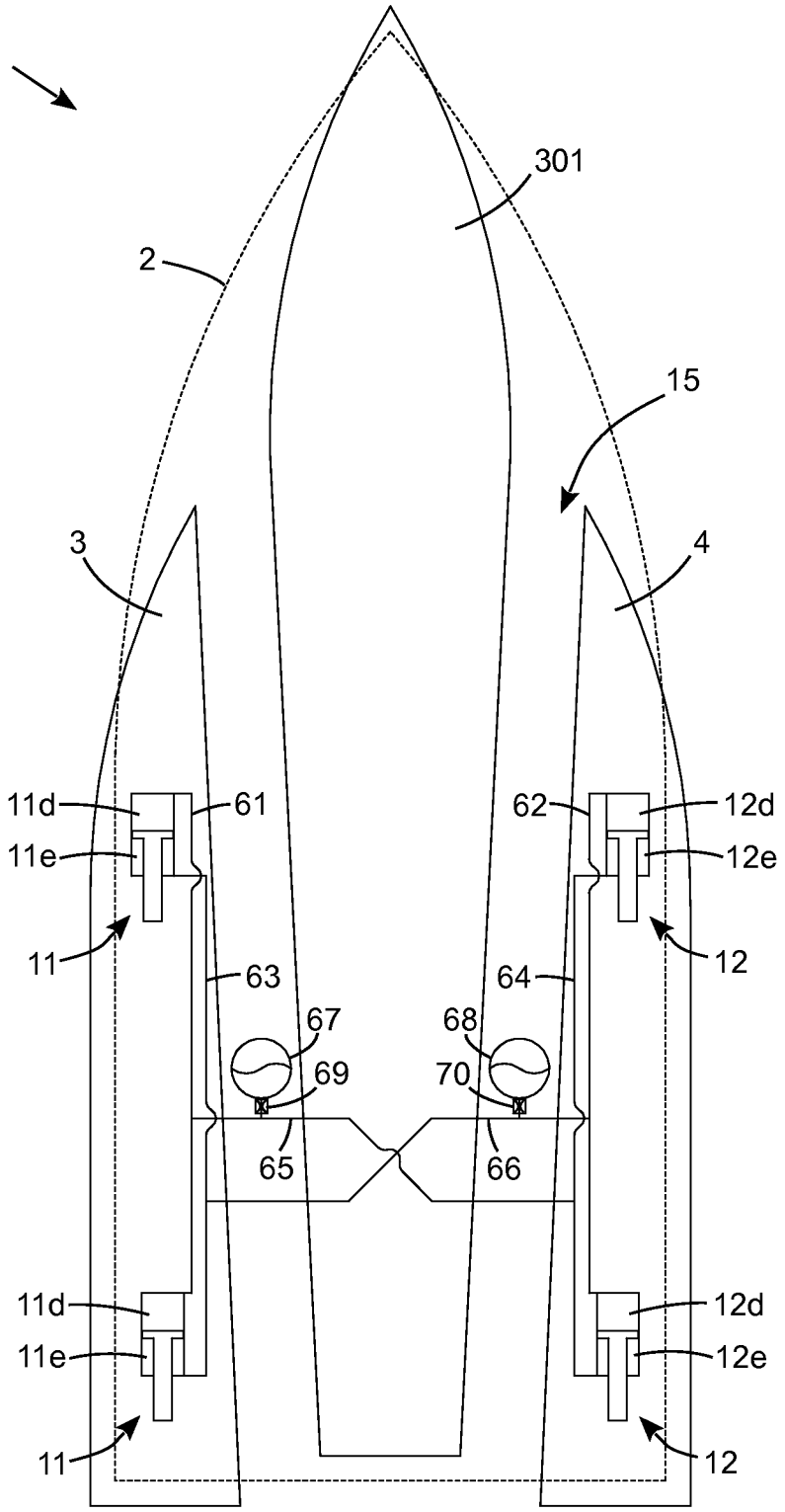

FIG. 15 shows an alternative layout of the fixed hull and the movable left and right (side) hulls, similar to FIGS. 11 and 12, but with the fixed hull having more buoyancy in the nose as opposed to the long slender nose of the fixed hull in the earlier figures. The fixed hull also tapers towards the rear as the side hulls are located towards the rear of the vessel providing significant support to the rear of the body or chassis. The side hulls are also asymmetric for improved flow around the multiple hulls and reduced water height in the spaces between the fixed and side hulls.

The interconnected arrangement of modal support rams of the suspension system in FIG. 15 has a different layout but ultimately the same connectivity as the arrangement in FIG. 13, much as the roll circuits (the left and right roll compression volumes) in FIGS. 3 and 4.

Figure 16:
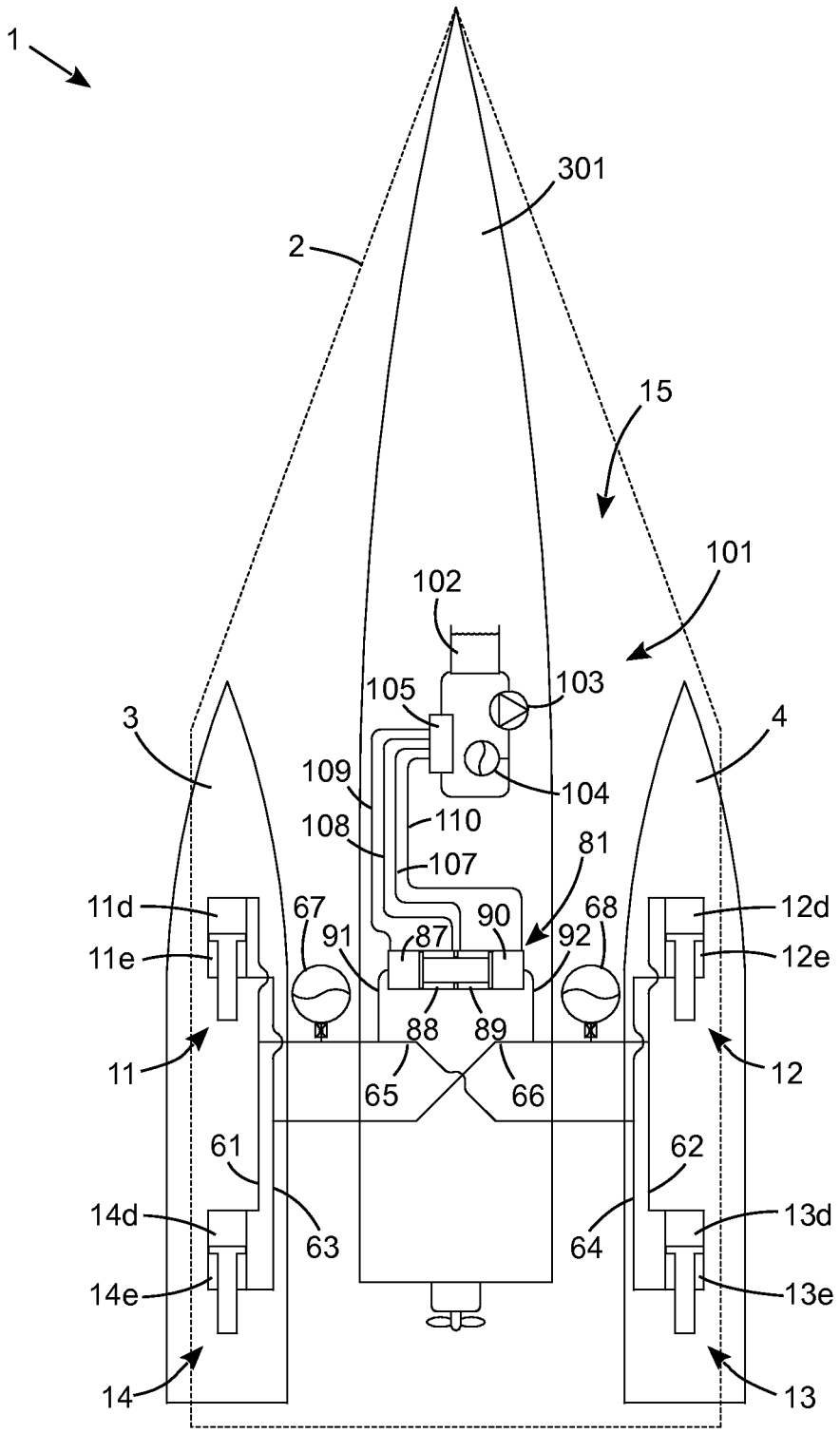
FIG. 16 is a schematic diagram showing an attitude control addition to the suspension system of FIG. 4.

As shown in FIG. 16, the active roll control including the roll fluid displacement device 81 and fluid supply system 101 applied in FIG. 5 to the roll circuits of FIG. 4 can be readily applied to the roll circuits of FIGS. 3, 6, 13 and 15.

Figure 17:
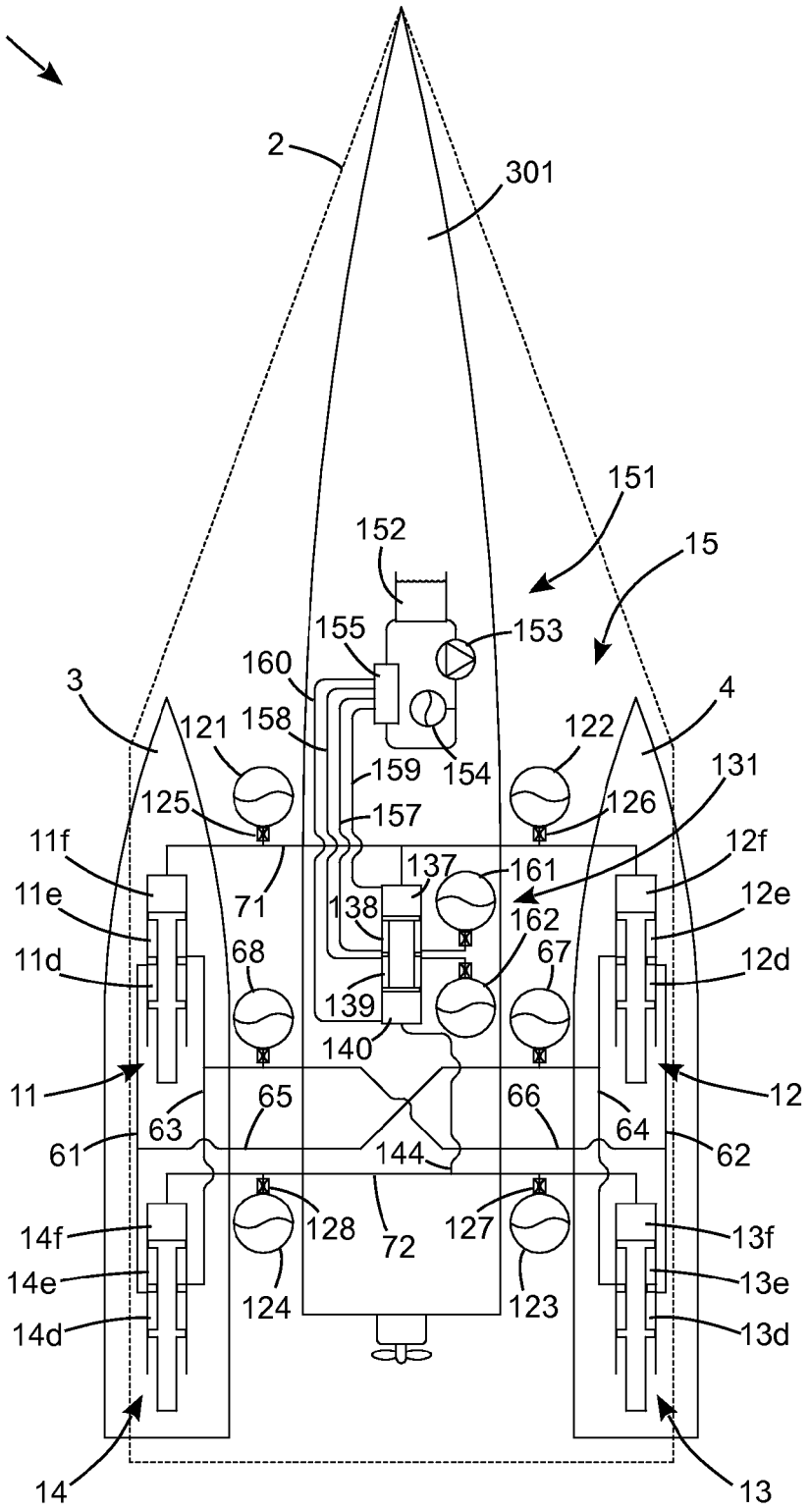
FIG. 17 is a schematic diagram showing a further modification of the suspension system of FIG. 4 incorporating an alternative attitude control addition.

In FIG. 17 the modal support ram and interconnection arrangement of FIG. 6, including the pitch fluid displacement device 131 and fluid supply system 151, is applied to a trimaran. As discussed above, the pitch stiffness requirements of the suspension system can be different between the catamaran and a trimaran if the (third) fixed hull of the trimaran provides a large portion of the pitch support of the body, i.e. if the fixed hull has a significantly larger longitudinal distribution of buoyancy than the side hulls, providing pitch stiffness or pitch attitude control in the suspension system primarily provides pitch stiffness of the side hulls relative to the body, or pitch attitude control of the side hulls relative to the body. Therefore the pitch fluid displacement device displaces fluid due to average pitch displacement of the left and right (side) hulls. The modal support rams still do not provide a warp stiffness to the suspension system. Adjusting the displacement of the piston rod assembly of the pitch displacement device can adjust the average pitch attitude of the left and right hulls (3 and 4) relative to the pitch attitude of the body or chassis 2. The control system 151 can supply fluid through the front and back pitch control conduits 157 and 158 to displace the piston-rod assembly of the pitch displacement device through the front and back control chambers 138 and 139. The front and back supply conduits 159 and 160 can be used to maintain the front and back pitch volumes or, if the pitch displacement device is omitted, to control the pitch attitude of the left and right hulls relative to the body. Alternatively or additionally to the supply system, pitch resilience accumulators 161 and 162 may be provided in fluid communication with the front and back control chambers 138 and 139. This can be used for example when it is desired to provide a lower pitch stiffness than heave stiffness.

Similarly the modal support means and interconnection means (i.e. the interconnected ram arrangements) from FIGS. 7, 8 and 9 can also be applied to a trimaran.

Figure 18:
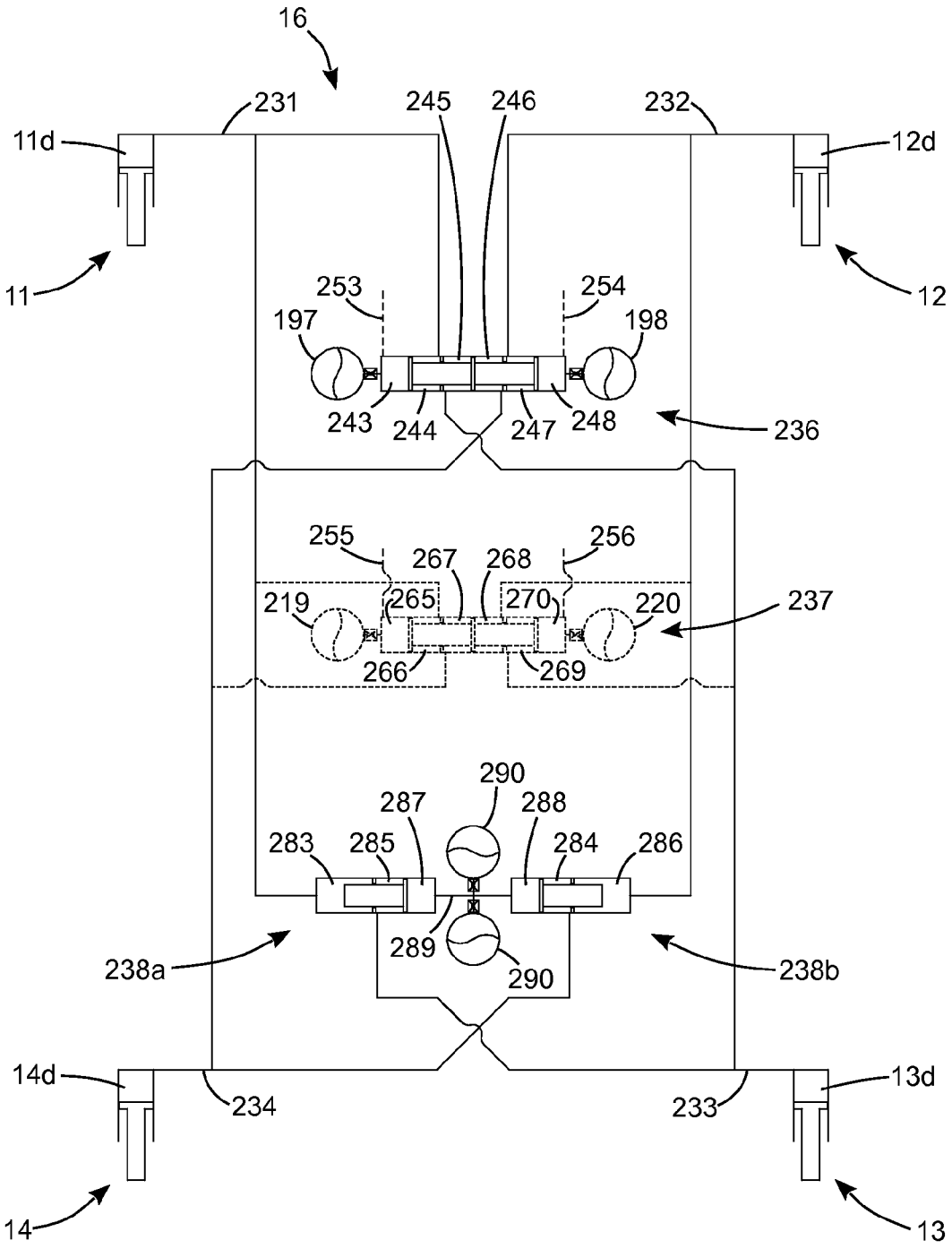
FIG. 18 is a schematic diagram showing an alternative connectivity of a suspension system for a water craft in accordance with the present invention.

The suspension system interconnection shown in FIG. 18 is the same as that shown in FIG. 10. As noted in the description of FIG. 10, the warp device does not provide pitch resilience. In FIG. 18 although the pitch displacement device 237 is shown in dotted lines as it can be optional, if it is omitted the average pitch displacement of the left and right hulls relative to the chassis and fixed hull is constant. Each of the side hulls can still pitch relative to other (as that is a warp mode of the suspension system) but their average pitch attitude relative to the chassis would be fixed.

As demonstrated by the various suspension system examples applied to both catamarans and trimarans above, it will be appreciated that there are many variations to the interconnection means which may be employed to provide a modal suspension system (wherein different stiffness rates exist between at least two of the suspension modes) for a body which is at least partially supported above a left and a right hull at four points, that is, two longitudinally spaced points on each side hull. Indeed many other known suspension interconnection arrangements can be applied to both catamarans and trimarans. Typically it is preferable to provide a roll stiffness with a lower or zero warp or torsional stiffness of the suspension system.

The construction of the various displacement means can be varied, for example by utilizing two rods and one piston in place of two pistons and one rod, or changing the rod versus cylinder diameter in a displacement device and changing the connections around to maintain the same functionality. As long as the relationship is maintained between which chambers are increasing in volume and which are decreasing in volume, the basic functionality is retained.

The modal support means are shown as hydraulic rams for clarity, although other devices can be used such as fluid bags. The modal support means and interconnection means are generally fluid filled, i.e. hydraulic components. However, at least some of the components can be pneumatic, and the use of gas in place of liquid can reduce the need for separate pressure accumulators in the suspension system.

The damper valves shown can be controlled valves and may be or incorporate lock out valves. Such valves are optional, but can optionally be used in the conduits and/or at the ports of the rams as well as or in place of the valves shown in the drawings between the various volumes and their associated accumulators.

Multiple accumulators can be provided for each volume or mode with some of the accumulators being locked off from the volumes to increase the stiffness when required. This and control of accumulator damping may be used in place of powered displacement devices (or at least decrease their need for operation and therefore decrease power consumption) to reduce uncomfortable accelerations on the chassis such as roll and/or pitch.

The suspension system can include additional support means between the side hulls and the body or chassis (i.e. the interconnected or modal support rams can be complemented by independent support means which can be of any known type). These can be used to reduce the load on the interconnected suspension components and/or provide a limited suspension in the event of a failure or sustained power loss, however the use of such independent support means generally provides a warp or torsional stiffness, so may only operate when the modal support rams are compressed to a shorter length than a normal operating position.

Figure 19:
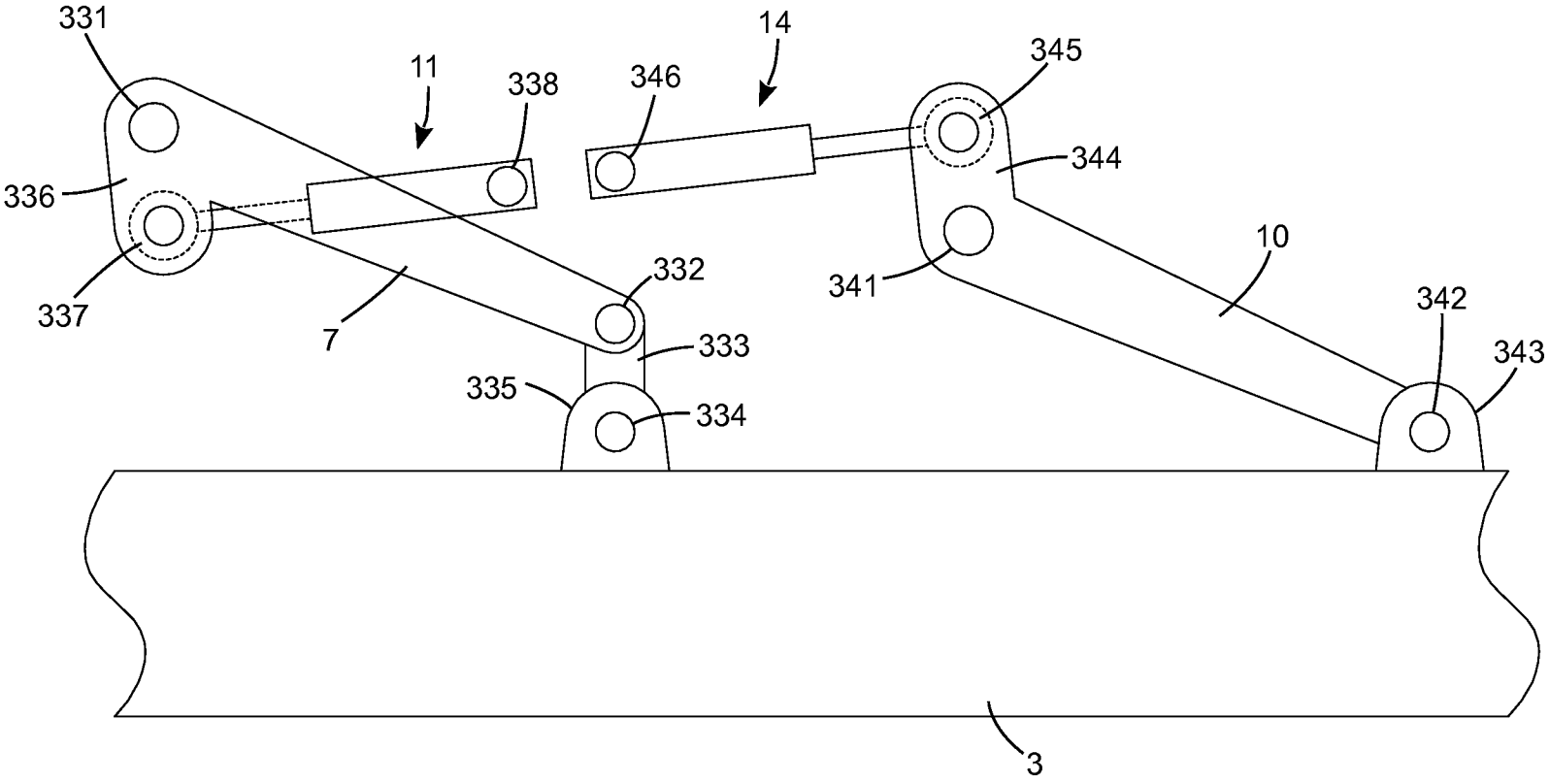
FIG. 19 is a diagrammatic side view of a locating means in accordance with at least one embodiment of the present invention.

As discussed above in relation to FIGS. 1 and 11, various locating means can be used, but typically a locating linkage including trailing arms, leading arms, drop links, wishbones or other known linkage types would be used. FIG. 19 shows a preferred locating linkage arrangement using trailing arms 7 and 10, and to accommodate pitch motions separately to heave motions, a drop link 333 is used on one of the trailing arms. In the example shown, the front left trailing arm 7 is pivoted to the body or chassis (not shown) at a bearing, bushing or pivot point 331 which has a substantially lateral horizontal axis to permit a pitch direction rotation while providing stable location about a roll and a yaw direction. A similar laterally extending bearing, bushing or pivot point 332 is shown at the opposite end of the trailing arm, connecting to a drop link 333 which is in turn connected to a mounting structure 335 on the hull 3 by another laterally extending bearing, bushing or pivot point 334. Rather than mounting the support means or modal support ram 11 directly between the body and the hull which can require a long stroke ram with components exposed to the marine environment, it can be desirable to use a mechanical advantage or lever mount arrangement as shown. The trailing arm 7 includes a lever portion 336 to which one end (preferably the rod end) of the ram is connected by a pivot or other rotating joint 337. The other part of the ram (preferably the cylinder bore in this case) is connected to the body or chassis by another pivot or other rotating or flexible joint 338. This as the distance between the hull and the body reduces, the ram is compressed. Some rams can be mounted such that they extend as the distance between the hull and the body reduces in which case, the compression and rebound chambers need to be redefined to ensure the correct connectivity and functionality within the suspension system is maintained.

Although the drop link 333 is shown intermediate the front trailing arm and the hull, such an intermediate link can alternatively be used between the arm and the body, particularly if the support ram 11 is connected between the body and either the trailing arm 7 or the hull directly.

The back left trailing arm 10 is similarly mounted to the body by a bearing, bushing or pivot point 341 which has a substantially lateral horizontal axis to permit a pitch direction rotation while providing stable location about a roll and a yaw direction. A similar laterally extending bearing, bushing or pivot point 342 is shown at the opposite end of the trailing arm, connecting to a mounting structure 343 on the hull 3. The lever arm portion 344 of arm 10 is connected to one end of the ram 14 by a pivot or other rotating or flexible joint 345, while the other part of the ram is connected to the body or chassis by another pivot or other rotating or flexible joint 346. One advantage of this arrangement of rams and trailing arms is that all the suspension loads can be resolved within a structure such as a sub-frame, which is in turn mounted to the body or chassis. Such a sub-frame can include longitudinally and even laterally extending beams to distribute the suspension loads into the body over a large area, reducing the stresses on the body. The mounting of the sub-frame can be resilient to further improve the comfort of the vessel by providing additional isolation between the wave inputs and the body and if the motors are mounted in the side hulls, such resilient mounting will also providing some isolation from the engine noise and vibrations.

Figure 20:
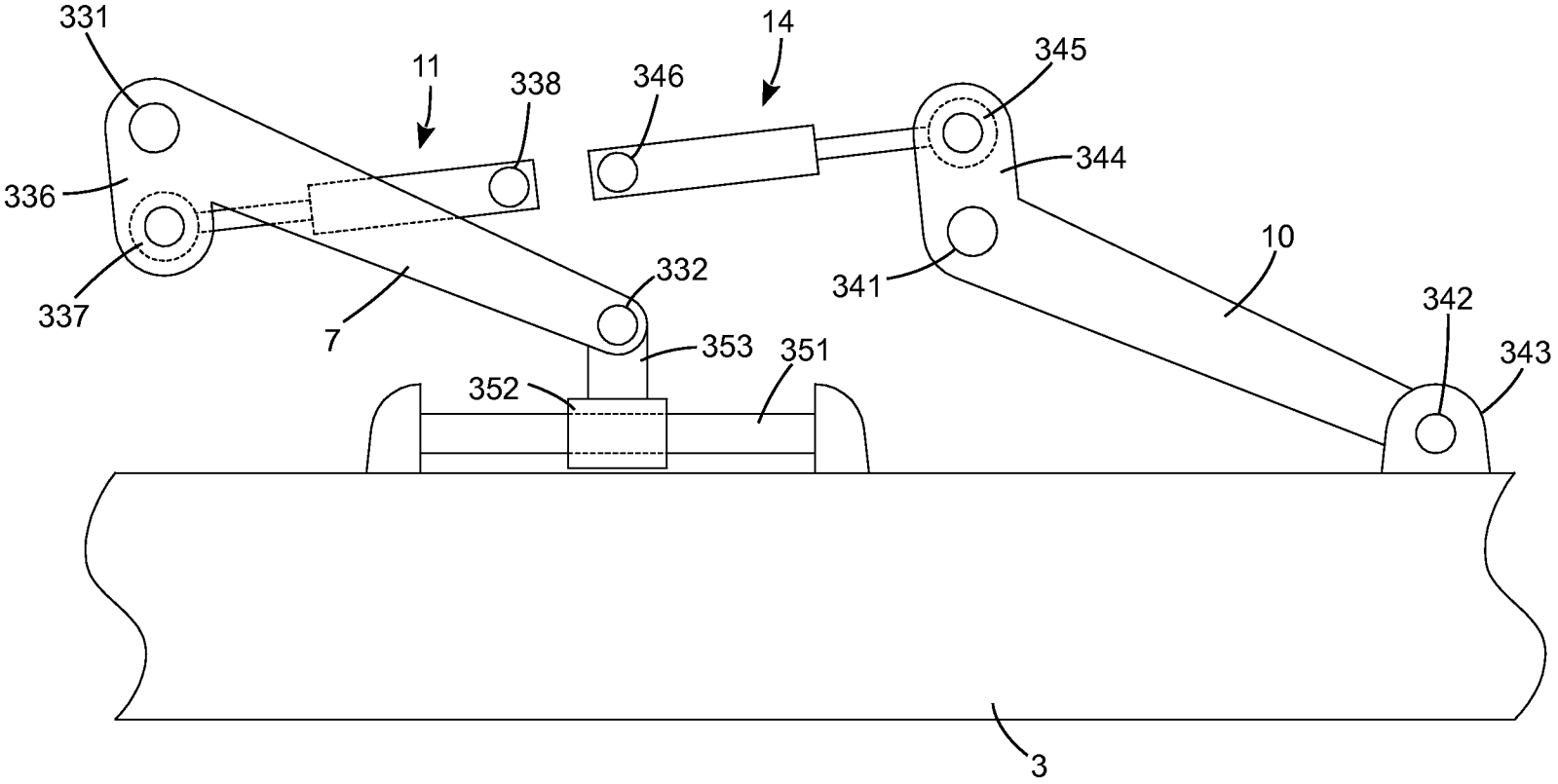
FIG. 20 is a diagrammatic side view of the locating means of FIG. 19 incorporating a modification.

The drop link 333 in FIG. 19 (with bearings or pivot points at both ends) can be replaced with any other means which allows for the relative length change between the body and hull mounting points of one of the arms in a pitch motion of the hull relative to the body. For example a sliding joint can be used as shown in FIG. 20, including a substantially longitudinal bar 351 mounted to the hull 3 and a sleeve 352 usually holding a bearings or a bushing to allow the sleeve to slide easily along the bar 351. Preferably, the arm 7 is pivoted directly on the sleeve, such as on a lateral axis perpendicular to and passing through the major axis of the bar 351, using a clevis joint for example to saddle the sleeve. Alternatively as shown for clarity, the sleeve 352 can include a vertical structure or rigid link 353 which is in turn pivotally connected to the arm 7. An alternative sliding geometry can be formed by adding a sliding joint into the actual arm 7 to allow the length of the arm to increase and decrease (i.e. the arm 7 may be telescopic). With any of these trailing arm arrangements, one or both trailing arm (7 and/or 10) can be replaced with a leading arm.

A further advantage of the mechanical advantage or lever mounting arrangement for the support rams 11 and 14 is that using a geometry such as that shown, the cylinders of the two rams can be located close together with very little motion which allows for easy and efficient hydraulic connection with shorter conduits and flow paths than possible using direct body to hull mounted rams.

The suspension system examples in FIGS. 2-10 and FIGS. 12-17 utilize hydraulic rams and conduits although other mechanical and fluid systems are possible. The hydraulic systems are shown as the preferred embodiments of the invention due to their relatively small size and easily routed interconnections and ability to provide modal damping (i.e. different damping rates between roll and pitch for example, which have different natural frequencies so can required different damping to suit).

Figure 21:
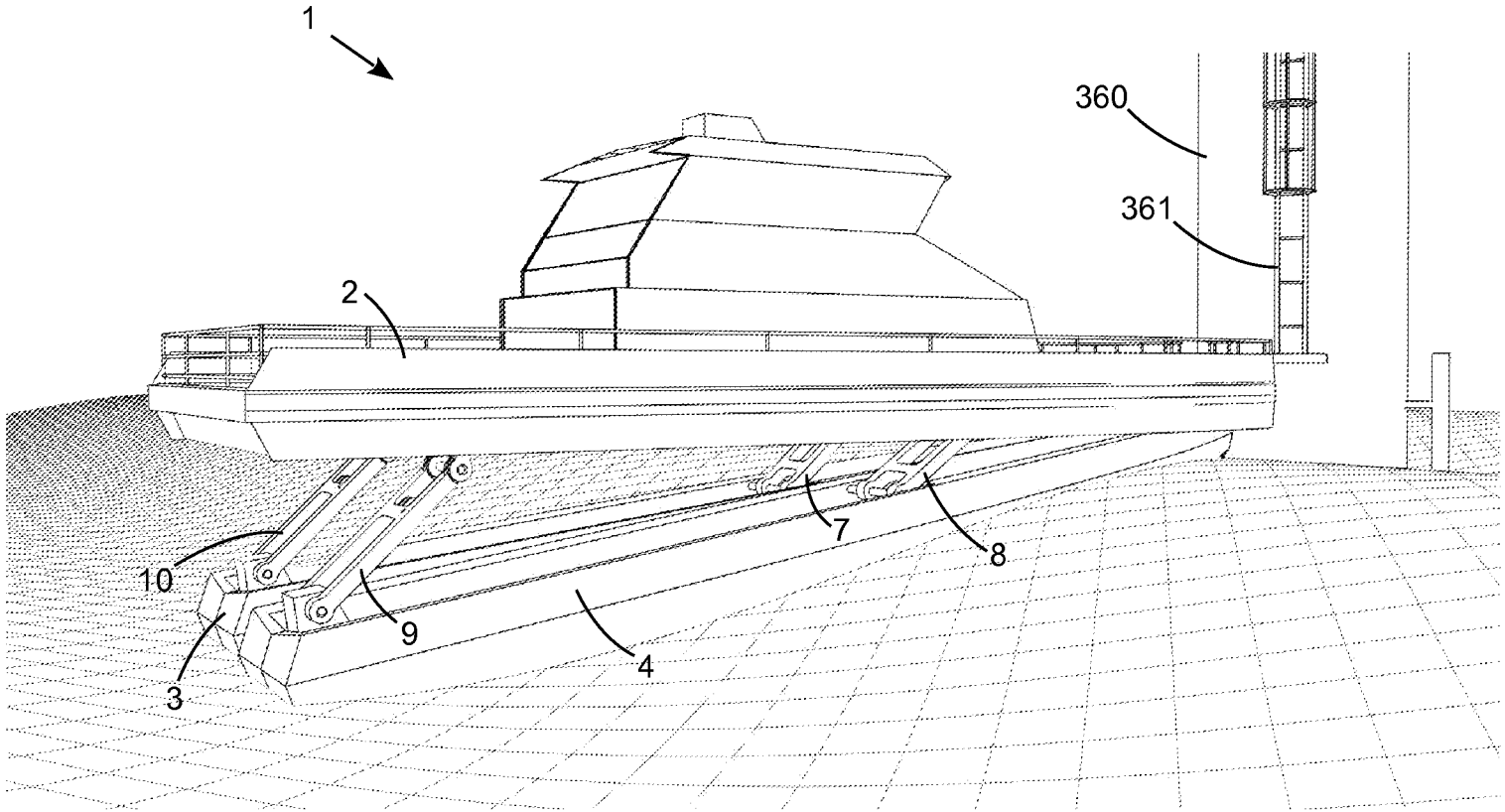
FIG. 21 is a perspective view of a water craft in accordance with the present invention.

Furthermore, hydraulic systems are readily adaptable to active control as shown in FIGS. 5, 6, 9, 10, 16, 17 and 18. The use of active body control can be highly desirable in some applications, for example, reducing body motions to improve stability and reduce relative motions between the body and stationary structures such as the legs of offshore oil platforms or the foundations of offshore wind turbines. FIG. 21 shows a catamaran version of the watercraft, with its bow adjacent a leg, foundation or other similar structure 360. Active body control is being used to minimize the pitch of the body 2, reducing the motion between the bow of the water craft and the access ladder 361 on the leg 360 of the marine structure.

The use of active body control not only improves safety of transfers and increases the range of sea states in which transfers are possible, but it can also allow a simple passive gangway to be used in place of a powered, actively controlled gangway. However, if such active gangways are used, the sea states in which the offshore platforms are safely available is further increased.

The active control can be used to power the body level for transfers, or to minimize the motion between for example the bow of the vessel (or the distal end of a gangway) and the offshore platform or structure. It can also be used to improve comfort during transit to reduce fatigue and allow any personnel or passengers to arrive at their destination in a more healthy condition, more alert and able to perform their duties with less time lost due to the effects of boat accelerations on the human body.

Although various exemplary embodiments of the invention have been disclosed, it should be apparent to those skilled in the art that various changes and modifications can be made which will achieve some of the advantages of the invention without departing from the true scope of the invention.

What is claimed is:

1. A multi-hulled water craft consisting of:

a body and two movable hulls, the two movable hulls comprising one left hull and one right hull, each hull connected to the body by respective locating means which permits at least substantially vertical and pitch motion of the respective hull relative to the body; and a suspension system including:

a. at least a front left modal support means disposed between a front portion of the left hull and the body and a back left modal support means disposed between a back portion of the left hull and the body, the front left modal support means and the back left modal support means being extendible and contractible and providing at least partial support of the body with respect to the left hull, the front left modal support means and the back left modal support means longitudinally spaced relative to the left hull such that:

i. a pitch displacement of the left hull relative to the body causes a difference between extension or contraction of the front right modal support means and extension or contraction of the back left modal support means; and ii. a heave displacement of the left hull relative to the body causes either both the front left and back left modal support means to contract or both the front left and back left modal support means to extend; and b. at least a front right modal support means disposed between a front portion of the right hull and the body and a back right modal support means disposed between a back portion of the right hull and the body, the front right modal support means and the back right modal support means being extendible and contractible and providing at least partial support of the body with respect to the right hull, the front right modal support means and the back right modal support means longitudinally spaced relative to the right hull such that:

i. a pitch displacement of the right hull relative to the body causes a difference between extension or contraction of the front right modal support means and extension or contraction of the back right modal support means; and ii. a heave displacement of the right hull relative to the body causes either both the front right and back right modal support means to contract or both the front right and back right modal support means to extend;

the suspension system further including an interconnection means that interconnects the modal support means to provide different stiffness between motions in at least two of roll, pitch, heave and warp suspension modes where the roll mode is a heave of the left and right hulls in opposite directions and the warp mode is a warp-pitch of the left and right hulls in opposite directions.

2. A multi-hulled water craft as claimed in claim 1 wherein the suspension system is arranged to substantially support the body.

3. A multi-hulled water craft as claimed in claim 2 wherein the interconnection means of the suspension system provides a pitch stiffness between the body and an average pitch position of the left and right hulls relative to the body.

4. A multi-hulled water craft as claimed in claim 3 wherein the suspension system further includes a pitch attitude control means for controlling the pitch attitude of the vessel.

5. A multi-hulled water craft as claimed in claim 2 wherein the interconnection means provides a roll and/or heave stiffness and a pitch and/or warp stiffness that is lower than the roll and/or heave stiffness.

6. A multi-hulled water craft as claimed in claim 1 wherein the body includes a fixed hull, and the left and right hulls provide only partial support of the body.

7. A multi-hulled water craft as claimed in claim 6 wherein the interconnection means of the suspension system provides a pitch stiffness of the left and right hulls relative to the body.

8. A multi-hulled water craft as claimed in claim 7 wherein the suspension system further includes a pitch attitude control means for controlling the pitch attitude of the left and right hulls.

9. A multi-hulled water craft as claimed in claim 6 wherein the interconnection means provides a roll and/or pitch stiffness and a heave and/or warp stiffness that is lower than the roll and/or pitch stiffness.

10. A multi-hulled water craft as claimed in claim 1 wherein the body includes a water engaging portion, the body being movable between a first position where the water engaging portion is in contact with the water and a second position where the water engaging portion is above the water.

11. A multi-hulled water craft as claimed in claim 1 wherein the interconnection means provides at least a roll or pitch stiffness between the body and the left and right hulls without providing a corresponding torsional stiffness between the modal support means.

12. A multi-hulled water craft as claimed in claim 1 wherein the interconnection means provides at least a roll stiffness between the body and the left and right hulls while providing substantially zero torsional stiffness between the modal support means.

13. A multi-hulled water craft as claimed in claim 1 wherein the suspension system further includes at least one independent support device to provide partial support of the body independent of the interconnection means.

14. A multi-hulled water craft as claimed in claim 13 wherein a respective independent support means is provided on each hull and the body, longitudinally spaced between the front and the back modal support means of the hull thereby providing roll and heave stiffness.

15. A multi-hulled water craft as claimed in claim 13 wherein a front and a rear independent support means are provided on each hull thereby providing stiffness in each of the roll, pitch, heave and warp suspension modes.

16. A multi-hulled water craft as claimed in claim 1 wherein the respective locating means of the left and right hulls each includes a front and a back locating linkage means.

17. A multi-hulled water craft as claimed in claim 16 wherein each front left, back left, front right and back right locating linkage means includes a respective trailing arm, one of the front or back locating linkage means of the left hull and one of the front or back locating linkage means of the right hull including a respective intermediate link, each intermediate link having a first connecting point rotatably connected to the respective trailing arm and having a second connecting point rotatably or slidably connected to the body or the respective hull.

18. A multi-hulled water craft as claimed in claim 16 wherein the respective modal support means each includes at least one hydraulic ram connected between the body and the respective locating means.

19. A multi-hulled water craft as claimed in claim 1 wherein the suspension system further includes a roll attitude control means for controlling the roll attitude of the vessel.

20. A multi-hulled water craft as claimed in claim 1 wherein each modal support means comprises at least one hydraulic ram and the interconnection means includes fluid conduits.

21. A multi-hulled water craft as claimed in claim 20 wherein the interconnection means further includes at least one modal displacement device.

* * * * *

UNITED STATES PATENT AND TRADEMARK OFFICE

CERTIFICATE OF CORRECTION

PATENT NO. : 9,061,735 B2
APPLICATION NO. : 13/678965
DATED : June 23, 2015
INVENTOR(S) : Christopher Brian Heyring et al.

It is certified that error appears in the above-identified patent and that said Letters Patent is hereby corrected as shown below:

On title page, item 71 Applicant,
replace "Margaret River (AU)"
with "Dunsborough (AU)"

Signed and Sealed this
Twenty-fourth Day of November, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,061,735 B2
APPLICATION NO. : 13/678965
DATED : June 23, 2015
INVENTOR(S) : Christopher Brian Heyring et al.

It is certified that error appears in the above-identified patent and that said Letters Patent is hereby corrected as shown below:

In the claims,

In Col. 19, line 22
replace "front right modal support means"
with "front left modal support means"

In Col. 19, line 56
replace "warp mode is a warp-pitch of the left and right hulls"
with "warp mode is a pitch of the left and right hulls"

Signed and Sealed this
Thirty-first Day of May, 2016

Michelle K. Lee

Michelle K. Lee
*Director of the United States Patent and Trademark Office*